US008080356B2

(12) United States Patent
Teshima

(10) Patent No.: US 8,080,356 B2
(45) Date of Patent: Dec. 20, 2011

(54) LIQUID DEVELOPER AND A METHOD OF FORMING IMAGE

(75) Inventor: Takashi Teshima, Shiojiri (JP)

(73) Assignee: Seiko Epson Corporation, Toyko (JP)

( * ) Notice: Subject to any disclaimer, the term of this patent is extended or adjusted under 35 U.S.C. 154(b) by 458 days.

(21) Appl. No.: 12/405,001

(22) Filed: Mar. 16, 2009

(65) Prior Publication Data

US 2009/0233216 A1 Sep. 17, 2009

(30) Foreign Application Priority Data

Mar. 17, 2008 (JP) ..... 2008-068515
Aug. 25, 2008 (JP) ..... 2008-215836

(51) Int. Cl.
*G03G 9/13* (2006.01)

(52) U.S. Cl. ..... 430/115; 430/117.5

(58) Field of Classification Search ..... 430/115, 430/117.5
See application file for complete search history.

(56) References Cited

U.S. PATENT DOCUMENTS 6,029,036 A 2/2000 Itaya et al. ..... 399/239
2006/0166148 A1* 7/2006 Teshima et al. ..... 430/434
2009/0324269 A1* 12/2009 Iraqi ..... 399/57

FOREIGN PATENT DOCUMENTS

JP 07-152256 6/1995

* cited by examiner

*Primary Examiner* — Hoa Le
(74) *Attorney, Agent, or Firm* — DLA Piper LLP (US)

(57) ABSTRACT

A liquid developer is provided. The liquid developer comprises: an insulation liquid constituted of a modified epoxy compound as a main component thereof; toner particles dispersed in the insulation liquid; and a cation type photopolymerization initiator used for polymerizing the modified epoxy compound. The liquid developer has superior fixing characteristics and is capable of forming an image at a high speed. Further, a method of forming an image is also provided.

9 Claims, 4 Drawing Sheets

LIQUID DEVELOPER AND A METHOD OF FORMING IMAGE

CROSS-REFERENCE TO RELATED APPLICATION

This application claims priorities to Japanese Patent Applications No. 2008-068515 filed on Mar. 17, 2008 and No. 2008-215836 filed on Aug. 25, 2008 which are hereby expressly incorporated by reference herein in their entireties.

BACKGROUND

1. Technical Field

The present invention relates to a liquid developer and a method of forming an image, and in particular relates to a liquid developer and a method of forming an image by using the liquid developer.

2. Related Art

As a developer used for developing an electrostatic latent image formed on a latent image carrier, there are known two types. One type of such a developer is known as a dry toner which is formed of a material containing a coloring agent such as a pigment or the like and a binder resin, and such a dry toner is used in a dry condition thereof.

The other type of such a developer is known as a liquid developer (liquid toner) which is obtained by dispersing toner particles into a carrier liquid (insulation liquid) having electric insulation properties (one example of such a liquid developer is disclosed in JP-A-7-152256).

In the developing method using such a dry toner, since a solid state toner is used, there is an advantage in handleability thereof. On the other hand, however, this method involves problems in that an adverse effect against a human body is likely to be caused by toner powder, contamination is likely to occur by dispersal of toner powder, and toner particles are likely to be massed together in a cartridge.

Further, in such a dry toner, since aggregation of toner particles is likely to occur in the producing process thereof, it is difficult to obtain toner particles each having a sufficiently small diameter. This means that it is difficult to form a toner image having high resolution.

Furthermore, there is also a problem in that when the size of the toner particle is made to be relatively small, the problems resulted from the powder form of the dry toner described above become more serious.

On the other hand, in the developing method using the liquid developer, since aggregation of toner particles in the liquid developer is effectively prevented, it is possible to use very fine toner particles and it is also possible to use a binder resin having a lower softening point (a low softening temperature).

As a result, the method using the liquid developer has such advantages as good reproducibility of an image composed of thin lines, good tone reproducibility as well as good reproducibility of colors. Further, the method using the liquid developer is also superior as a method for forming an image at high speed.

However, when such a liquid developer is used, an insulation liquid is adhering to a surface of each toner particle during a fixing process of the toner particles.

In the conventional liquid developer, there is a problem in that such an insulation liquid adhering to the surfaces of the toner particles lowers fixing strength of the toner particles to a recording medium.

Further, in order to improve the fixing strength of the toner particles, the toner particles are heated at a relatively high temperature for a long period of time, thereby fixing the toner particles to the recording medium. However, in view of energy saving and high speed trends of recent years in the images formation, it is difficult to satisfy the trends.

SUMMARY

Accordingly, it is an object of the present invention to provide a liquid developer which has superior fixing characteristics of toner particles to a recording medium and is capable of forming an image at a high speed. Further, it is also another object of the present invention to provide a method of forming an image by using such a liquid developer.

These objects are achieved by the present invention described below.

In a first aspect of the present invention, there is provided a liquid developer. The liquid developer comprises an insulation liquid constituted of a modified epoxy compound as a main component thereof; toner particles dispersed in the insulation liquid; and a cation type photopolymerization initiator used for polymerizing the modified epoxy compound, the cation type photopolymerization initiator contained in the insulation liquid.

In the liquid developer according to the present invention, it is preferred that the modified epoxy compound is an epoxidized vegetable oil obtained by epoxidizing carbon double bonds of an unsaturated fatty acid component constituting a constituent material of a vegetable oil.

In the liquid developer according to the present invention, it is also preferred that an iodine value of the epoxidized vegetable oil is in the range of 15 or less.

In the liquid developer according to the present invention, it is also preferred that when the iodine value of the epoxidized vegetable oil is defined as "$I_1$" and an iodine value of the vegetable oil is defined as "$I_2$", the following relation is satisfied: $0 \leqq I_1/I_2 \leqq 0.17$.

In the liquid developer according to the present invention, it is also preferred that a number of the carbon double bonds of the unsaturated fatty acid component constituting the constituent material of the vegetable oil are two or more.

In the liquid developer according to the present invention, it is also preferred that the cation type photopolymerization initiator includes an aromatic sulfonium salt or an aromatic iodonium salt.

In the liquid developer according to the present invention, it is also preferred that an amount of the cation type photopolymerization initiator is in the range of 0.5 to 8 parts by weight with respect to 100 parts by weight of the modified epoxy compound.

In a second aspect of the present invention, there is provided a method of forming an image by using an image forming apparatus. The image forming apparatus includes four developing sections each having a photoreceptor and an intermediate transfer section being into contact with the photoreceptor, and the four developing sections corresponding to respective colors.

The method comprises: developing monochromatic images corresponding to the respective colors on the photoreceptors by using liquid developers of the respective colors, respectively; transferring the monochromatic images corresponding to the respective colors on the intermediate transfer section, respectively; forming an unfixed toner image onto an recording medium by overlaying the monochromatic images thereon; and fixing the unfixed toner image on the recording medium by irradiating an ultraviolet ray thereto to obtain a fixed toner image.

Each of the liquid developers is comprised of an insulation liquid constituted of a modified epoxy compound as a main component thereof, toner particles dispersed in the insulation liquid, and a cation type photopolymerization initiator used for polymerizing the modified epoxy compound, the cation type photopolymerization initiator dispersed in the insulation liquid.

In the method according to the present invention, it is preferred that in the fixing step an energy of the ultraviolet ray to be irradiated to the unfixed toner image is in the range of 25 to 500 mJ/cm$^2$, wherein the transferring, forming, and fixing steps are carried out while feeding the recording medium, wherein a feeding speed of the recording medium is in the range of 50 to 1000 mm/sec.

According to the present invention as described above, it is possible to provide a liquid developer which has superior fixing characteristics of toner particles to a recording medium and is capable of forming an image at a high speed. Further, it is also possible to provide a method of forming an image by using such a liquid developer.

DESCRIPTION OF EXEMPLARY EMBODIMENTS

Figure 1:
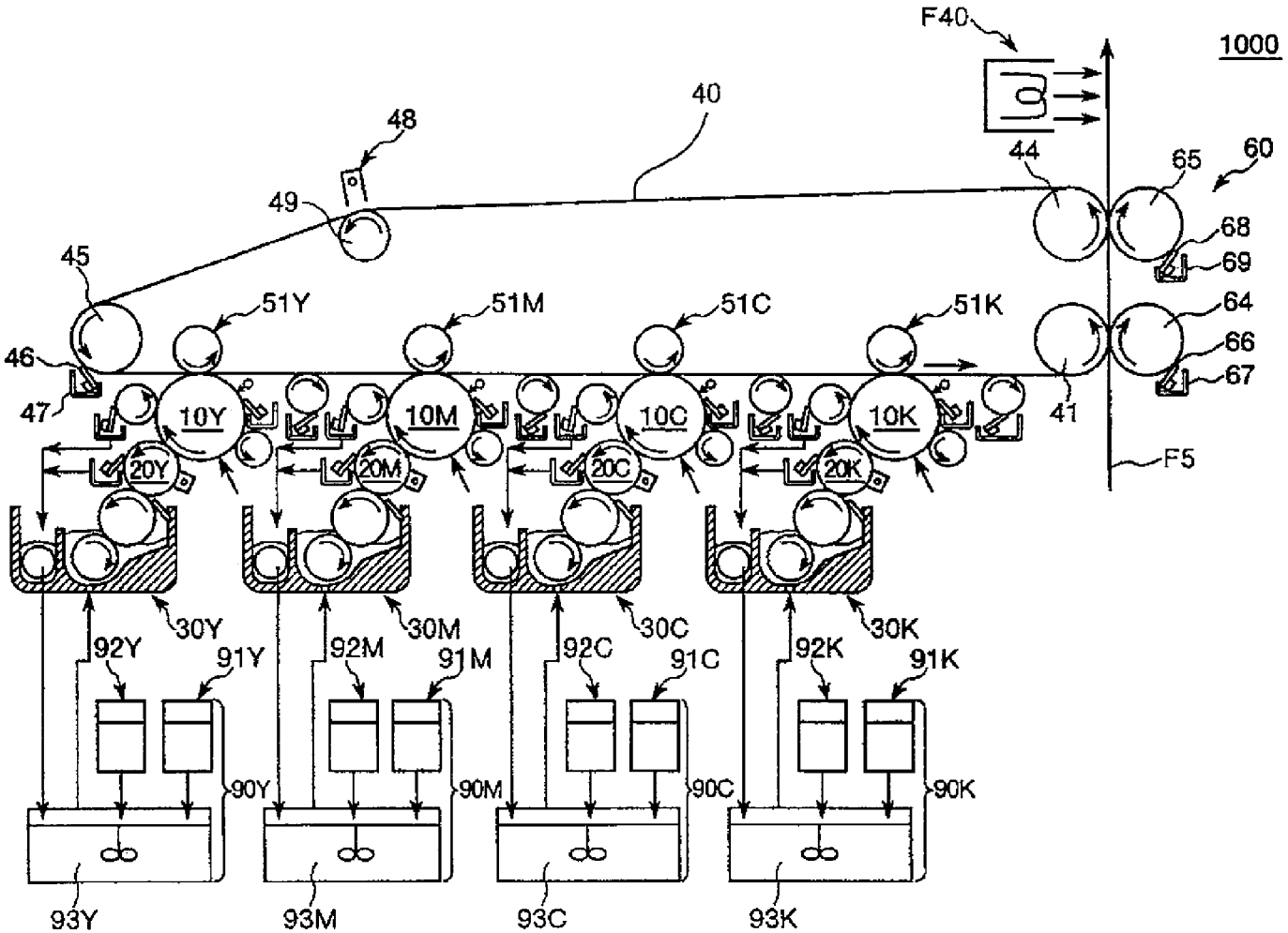
FIG. 1 is a schematic view which shows a preferred embodiment of an image forming apparatus that can be used to a first embodiment of a method of forming an image of the present invention.

Hereinbelow, with reference to the accompanying drawings, preferred embodiments of a liquid developer and a method of forming an image according to the present invention will be described in details.

Liquid Developer

First, a description will be made with regard to a liquid developer of the present invention. The liquid developer of the present invention includes an insulation liquid and toner particles dispersed in the insulation liquid as described below. Further, the liquid developer of the present invention also includes a cation type photopolymerization initiator.

Hereinafter, a description will be made on each of ingredients constituting the liquid developer.

Insulation Liquid

First, a description will be made with regard to the insulation liquid.

The insulation liquid constituting the liquid developer according to the present invention is constituted of a modified epoxy compound as a main component thereof.

In the present invention, the modified epoxy compound is a compound (epoxide) having at least one three-membered ring, which is referred to as an epoxy group (oxirane ring), in a molecular structure thereof. Further, the modified epoxy compound is a fluid compound having high insulation property, which can be used as an insulation liquid for a liquid developer.

In the meantime, in a method of forming an image using a conventional liquid developer, an insulation liquid contained in the conventional liquid developer adheres to the surfaces of toner particles when the toner particles are fixed onto a recording medium. In the conventional liquid developer, there is a problem in that such an insulation liquid adhering to the surfaces of the toner particles lowers fixing strength of the toner particles to the recording medium.

Further, in order to improve fixing strength of toner particles to the recording medium, there is a method as follows. The toner particles to which the insulation liquid adheres is heated at a relatively high temperature for a long period of time during a fixing process so that the insulation liquid is completely removed (dried) from the toner particles or the recording medium.

However, it is difficult to accomplish image formation at a high speed which is demanded in recent years.

In contrast, the liquid developer according to the present invention includes the cation type photopolymerization initiator as described later as well as the insulation liquid constituted of the modified epoxy compound as a main component thereof. Therefore, it is possible to improve fixing strength of the toner particles to a recording medium.

Generally, in a liquid including the modified epoxy compound and the cation type photopolymerization initiator as described above, if energy beam such as an ultraviolet ray (UV light), an electron ray (beam) or the like is irradiated to the liquid, the cation type photopolymerization initiator included therein is activated so that hydrogen ions are produced from the cation type photopolymerization initiator.

The hydrogen ions are reacted with epoxy groups of the modified epoxy compound, so that the modified epoxy compound is polymerized at the epoxy groups thereof and then is solidified. As a result, the liquid is solidified.

Therefore, in the present invention, the ultraviolet ray or the like is irradiated to a toner image, that is, the liquid developer (insulation liquid) including the modified epoxy compound transferred onto a recording medium. As a result, the modified epoxy compound included in the insulation liquid (toner image) is solidified around the toner particles, thereby firmly fixing the toner particles to the recording medium.

As described above, in the present invention, the insulation liquid (insulation liquid adhering to the surfaces of the toner particles) included in the liquid developer transferred onto the recording medium serves a function of firmly fixing the toner particles to the recording medium.

Further, such a modified epoxy compound is solidified at an extremely short time. Therefore, it is possible for the liquid developer of the present invention to quickly fix the toner particles to the recording medium as compared to a method of forming an image using a conventional liquid developer. The method of forming the image using the conventional liquid developer is carried out by applying heat energy to an unfixed toner image, and then fixing toner particles to a recording medium.

Therefore, the liquid developer according to the present invention can be reliably used for forming an image at a high speed.

Furthermore, in a method of forming an image using a general liquid developer, an insulation liquid contained in the general liquid developer exists on regions other than regions of a recording medium on which toner particles are transferred. Such an insulation liquid is a liquid having nonvolatility. Therefore, if images are formed on recording mediums continuously, the recording mediums on which the images are transferred adhere to each other. That is, there is a problem that such a phenomenon (blocking) occurs.

In contrast, in the present invention, the insulation liquid contained in the liquid developer is absolutely solidified on a recording medium during the fixing process. Therefore, it is possible to effectively prevent the problem described above from occurring.

Further, in the method of forming the image using the liquid developer according to the present invention, a toner image can be fixed to a recording medium by only irradiating energy beam to an unfixed toner image on the recording medium. Therefore, it is possible to save energy for forming the toner image as compared to a method of forming an image using a conventional liquid developer, wherein the method includes a fixing step of fixing a toner image onto a recording medium by heat.

Furthermore, in the liquid developer according to the present invention, the insulation liquid impregnates to a recording medium such as a paper, and then it is solidified. As a result, an anchor effect is generated between the solidified insulation liquid and the recording medium. This makes it possible to improve fixing strength of the toner particles to the recording medium.

Furthermore, in the method of forming the image using the liquid developer according to the present invention, a vinyl chloride film, a polypropylene film, and the like as well as the recording medium such as the paper which is impregnated by the insulation liquid can be also used as a recording medium. Although such a recording medium is not impregnated by the insulation liquid, it is possible to obtain relatively high fixing strength of the toner particles to such a recording medium.

Examples of such a modified epoxy compound include: epoxide in which at least a part of carbon double bonds of an unsaturated fatty acid component constituting a constituent material (glyceride) of a vegetable oil, a mineral oil, or the like is modified to an epoxy group; a modified epoxy-silicone oil in which at least a part of methyl groups of silicone constituting a silicone oil is substituted by an alkyl group containing an epoxy group; and the like. These compounds may be used singly or in combination of two or more of them.

Among the compounds mentioned above, in the unsaturated fatty acid component constituting the constituent material of the vegetable oil, a large number of the carbon double bonds to be modified to the epoxy groups are included. Therefore, epoxide in which at least a part of the carbon double bonds of the unsaturated fatty acid component constituting the constituent material of the vegetable oil is modified to the epoxy group (hereinafter, simply referrer to as "epoxidized vegetable oil") is polymerized by hydrogen ions derived from the cation type photopolymerization initiator and solidified reliably.

By using the epoxidized vegetable oil as the modified epoxy compound, it is possible to firmly fix the toner particles to a recording medium. Further, such an epoxidized vegetable oil has superior affinity to the toner particles (resin material) as described later. Therefore, it is possible to improve dispersibility of the toner particles in the liquid developer. As a result, preservability or storage stability of the liquid developer is improved.

In this regard, normally, a vegetable oil is constituted of fatty acid triglyceride which is triester (triglyceride) between a fatty acid containing an unsaturated fatty acid and glycerin. The fatty acid triglyceride includes an unsaturated fatty acid component (having carbon double bonds in a chemical structure thereof) derived from the fatty acid.

It is preferred that the constituent material of the vegetable oil used for producing such an epoxidized vegetable oil contains an unsaturated fatty acid component having two or more carbon double bonds as a constituent component thereof. The epoxidized vegetable oil obtained by modified the carbon double bonds of the unsaturated fatty acid component constituting the constituent material of such a vegetable oil to the epoxy groups is solidified at a short time. A hardness of the solidified epoxidized vegetable oil becomes sufficiently high.

Examples of the vegetable oil used for producing such an epoxidized vegetable oil include: drying oil such as dehydrated caster oil, wood oil, linseed oil, sunflower oil, rose hip oil, and perilla oil; semidrying oil such as soy oil, rape oil, safflower oil, cotton oil, sesame oil, and corn oil; and the like.

Among the vegetable oils mentioned above, linseed oil or soy oil is preferable. In other words, it is preferred that an epoxidized linseed oil obtained by modifying carbon double bonds of an unsaturated fatty acid component constituting a constituent compound of linseed oil to epoxy groups or an epoxidized soy oil obtained by modifying carbon double bonds of an unsaturated fatty acid component constituting a constituent compound of soy oil to the epoxy groups are used as the epoxidized vegetable oil.

The linseed oil and soy oil are oils having high stability. Therefore, they are preferably used as a starting material of the epoxidized vegetable oil. Further, the unsaturated fatty acid components constituting the constituent materials of the linseed oil and soy oil have a relatively large number of carbon double bonds.

Therefore, the epoxidized linseed oil and the epoxidized soy oil, which are obtained by using the linseed oil and the soy oil as the starting oil, respectively, are reliably polymerized by hydrogen ions generated from the cation type photopolymerization initiator described later and solidified.

As a result, it is possible to form images at high speed and improve fixing strength of the toner particles to the recording medium.

An iodine value of such a vegetable oil is preferably in the range of 70 to 220, and more preferably in the range of 80 to 200. The unsaturated fatty acid component constituting the constituent material of the vegetable oil having the iodine value falling within above noted range has a large number of the carbon double bonds in a chemical structure thereof.

Therefore, in the epoxidized vegetable oil obtained by modifying the carbon double bonds to the epoxy groups, the unsaturated fatty acid component constituting the constituent material of the epoxidized vegetable oil has a large number of the epoxy groups (oxirane rings) in a chemical structure thereof.

The insulation liquid containing such an epoxidized vegetable oil as a constituent component thereof is solidified at a more short time during the fixing process. Further, the solidified insulation liquid has sufficiently high hardness. This makes it possible to form images at a more high speed and reliably improve fixing strength of the toner particles to a recording medium.

An iodine value of such an epoxidized vegetable oil is preferably 15 or less, and more preferably 10 or less. The insulation liquid containing such an epoxidized vegetable oil as the constituent component thereof is solidified at a more short time during the fixing process. Further, the solidified insulation liquid has sufficiently high hardness. This makes it possible to form images at a more high speed and reliably improve fixing strength of the toner particles to the recording medium.

When the iodine value of the epoxidized vegetable oil is defined as "$I_1$" and the iodine value of the vegetable oil used for obtaining the epoxidized vegetable oil is defined as "$I_2$", the following relation is preferably satisfied: $0 \leqq I_1/I_2 \leqq 0.17$, and more preferably $0.01 \leqq I_1/I_2 \leqq 0.11$.

The epoxidized vegetable oil satisfying the relation has epoxy groups in a chemical structure thereof with a high amount. Therefore, it is possible to solidify the insulation liquid containing the epoxidized vegetable oil at a more short time, so that it is possible to reliably obtain sufficiently high hardness of the solidified insulation liquid.

This makes it possible to form images at a more high speed and reliably improve fixing strength of the toner particles to a recording medium. Further, the solidified epoxidized vegetable oil, that is, the solidified insulation liquid exhibits superior solvent resistance.

The insulation liquid may contain the following component in addition to the epoxidized vegetable oil as described above.

Examples of such a component include: a mineral oil (an aliphatic hydrocarbon) such as ISOPER E, ISOPER G, ISOPER H, ISOPER L ("ISOPER" is a product name of Exxon Mobil Chemical), SHELLSOL 70, SHELLSOL 71 ("SHELLSOL" is a product name of Shell Chemical Japan Ltd.), Amsco OMS, Amsco 460 solvent ("Amsco" is a product name of Spirit Co., Ltd.), low-viscosity or high-viscosity liquid paraffin (produced by Wako Pure Chemical Industries, Ltd.); a vegetable oil containing fatty acid glyceride, medium chain fatty acid ester, and the like; fatty acid monoester which is ester between a fatty acid and a mono-alcohol; octane, isooctane, decane, isodecane, decalin, nonane, dodecane, isododecane, cyclohexane, cyclooctane, and cyclodecane, benzene, toluene, xylene, mesitylene; and the like.

In the case where the insulation liquid also contains the component other than the epoxidized vegetable oil, an amount of the epoxidized vegetable oil contained in the insulation liquid is preferably 50 wt % or larger, more preferably 60 wt % or larger, and even more preferably 80 wt % or larger. This makes it possible to form images at a sufficiently high speed and reliably improve fixing strength of the toner particles to a recording medium.

The electric resistance of the insulation liquid at room temperature (20° C.) described above is preferably equal to or higher than $1\times10^{11}$ Ωcm, more preferably equal to or higher than $1\times10^{12}$ Ωcm, and even more preferably equal to or higher than $1\times10^{13}$ Ωcm. Further, the dielectric constant of the insulation liquid is preferably equal to or lower than 3.5.

A viscosity of the insulation liquid is not particularly limited to a specific value, but it is preferably in the range of 5 to 1000 mPa·s, more preferably in the range of 50 to 800 mPa·s, and even more preferably in the range of 50 to 500 mPa·s.

If the viscosity of the insulation liquid falls within the above range, in the case where the liquid developer is dipped from a developer container by an application roller in an image forming apparatus, an appropriate amount of the insulation liquid can adhere to the surfaces of the toner particles. As a result, it is possible to form images at a high speed and reliably improve fixing strength of the toner particles to a recording medium.

In this regard, it is to be noted that in this specification, the viscosity of the insulation liquid is measured at a temperature of 25° C.

Cation Type Photopolymerization Initiator

Next, a description will be made on the cation type photopolymerization initiator.

The cation type photopolymerization initiator is contained in the liquid developer according to the present invention. Such a cation type photopolymerization initiator is activated by irradiating energy beam such as an ultraviolet ray or the like, and then hydrogen ions are produced therefrom. Further, the cation type photopolymerization initiator has functions of polymerizing and curing the modified epoxy compound constituting the insulation liquid.

When the cation type photopolymerization initiator is contained in the liquid developer, the insulation liquid is quickly solidified by irradiating the energy beam such as the ultraviolet ray or the like to an unfixed toner image (liquid developer) which has been transferred to a recording medium. Then, the toner particles are firmly fixed to the recording medium.

Examples of such a cation type photopolymerization initiator include: a diazonium salt having an anion such as a halogen-based anion, a sulfonic acid-based anion, a carboxylic acid-based anion, and sulfuric acid-based anion as a counter ion; an onium salt such as a sulfonium salt, an aromatic sulfonium salt, an iodonium salt, an aromatic iodonium salt, and a phosphonium salt; and the like.

Among these salts mentioned above, the aromatic sulfonium salt or the aromatic iodonium salt having an aromatic ring in a chemical structure thereof is preferable. This is because the aromatic sulfonium salt and the aromatic iodonium salt are chemically stable compounds and it is difficult that hydrogen ions are produced by energy (heat energy or the like) other than the energy beam.

Therefore, it is possible to reliably prevent the cation type photopolymerization initiator from being activated when the liquid developer is stored or preserved, thereby preventing the cation type photopolymerization initiator from being polymerized and cured. As a result, it is possible to reliably preserve or store the liquid developer containing the cation type photopolymerization initiator for a long period of time.

Further, it is possible to quickly solidify the insulation liquid contained in the transferred liquid developer and firmly fix the toner particles to a recording medium during the fixing process.

The cation type photopolymerization initiator has high solubility to the modified epoxy compound as described above. Further, it is difficult for the cation type photopolymerization initiator to precipitate in the liquid developer. Therefore, during preservation or storage of the liquid developer, it is possible to prevent the cation type photopolymerization initiator from being precipitated in the liquid developer. As a result, it is also possible to reliably prevent a defect such as reduced preservability or storage stability of the toner particles from occurring.

Further, the cation type photopolymerization initiator can be uniformly dispersed in the liquid developer. Therefore, it is possible to quickly solidify the insulation liquid included in the unfixed toner image (liquid developer) by irradiating the energy beam to the unfixed toner image during the fixing process. As a result, it is also possible to obtain uniform fixing strength of the toner particles included in the toner image to a recording medium.

Furthermore, an amount of the cation type photopolymerization initiator contained in the liquid developer is preferably in the range of 0.5 to 8 parts by weight, and more preferably in the range of 2 to 5 parts by weight with respect to 100 parts by weight of the modified epoxy compound which constitutes the insulation liquid.

In the case where the amount of the cation type photopolymerization initiator contained in the liquid developer falls within above noted range, the cation type photopolymerization initiator can be uniformly dissolved in the liquid developer so that the liquid developer exhibits superior preservability or storage stability.

When the image is formed, it is also possible to firmly fix the toner particles onto the recording medium by irradiating the energy beam such as the ultraviolet ray or the like to the unfixed toner image (liquid developer). Further, it is also possible to reliably prevent electrical insulation property of the insulation liquid from being lowered.

Furthermore, if the amount of the cation type photopolymerization initiator contained in the liquid developer falls within above noted range, an inherent color of each of the toner particles are reliably displayed in the finally obtained toner image.

Toner Particles

Next, a description will be made with regard to the toner particles.

Constituent Material of Toner Particles (Toner Material)

The toner particles contained in the liquid developer of the present invention comprises at least a binder resin (resin material) and a coloring agent.

1 Resin Material (Binder Resin)

The toner particles contained in the liquid developer are constituted of a material which contains the resin material (binder resin) as its main component.

In the invention, there is no specific limitation on the kinds of the resin material (binder resin) to be used. Examples of such a resin material (binder resins) include heretofore known resin materials.

Among these resin materials, a polyester resin is preferably used. Since the polyester resin has good affinity with the modified epoxy compound described above, it is possible to make dispersibility of the toner particles in the insulation liquid excellent.

Among the modified epoxy compound, a chemical structure of the constituent material of the epoxidized vegetable oil is similar to a chemical structure of the polyester resin. Therefore, the epoxidized vegetable oil has high affinity with respect to the polyester resin. This makes it possible to make preservability or storage stability of the liquid developer more excellent by using the polyester resin as the resin material of the toner particles and the epoxidized vegetable oil as the constituent component of the insulation liquid.

Further, since the polyester resin has high transparency, in the case where the polyester resin is used as the binder resin, color development of an obtained image becomes excellent.

A softening point of the resin material is not limited to a specific value, but is preferably in the range of 50 to 130° C., more preferably in the range of 50 to 120° C., and even more preferably in the range of 60 to 115° C.

In this specification, the term "softening point" means a temperature at which softening is begun under the conditions that a temperature raising speed is 5° C./min and a diameter of a die hole is 1.0 mm in a high-floored flow tester (manufactured by Shimadzu Corporation).

2 Coloring Agent

The toner particles of the liquid developer may contain a coloring agent in addition to the resin material. As for a coloring agent, it is not particularly limited to a specific material, but known pigments, dyes or the like can be used.

3 Other Components

In the toner particles, additional components other than the above components may be contained. Examples of such other components include wax, magnetic powder, and the like.

Further, the toner material (constituent material of the toner particles) may further contain zinc stearate, zinc oxide, cerium oxide, silica, titanium oxide, iron oxide, a fatty acid, or a fatty acid metal salt, or the like in addition to the components described above.

Shape of Toner Particles

An average particle size (diameter) of the toner particles constituted of the above described materials is preferably in the range of 0.5 to 5 μm, more preferably in the range of 1 to 4 μm, and even more preferably in the range of 1 to 3.5 μm.

If the average particle size of the toner particles is within the above range, it is possible to make variation in properties of the toner particles small. As a result, it is possible to make resolution of a toner image formed from the liquid developer (liquid toner) sufficiently high while making the reliability of the obtained liquid developer as a whole sufficiently high.

Further, it is also possible to improve dispersibility of the toner particles in the liquid developer to a satisfactory level, thereby making the preservability or storage stability of the liquid developer excellent. In this specification, the term "average particle size" means an average particle size in volume basis.

An amount of the toner particles contained in the liquid developer is preferably in the range of 10 to 60 wt %, and more preferably in the range of 20 to 50 wt %.

Method of Producing Liquid Developer

Next, a preferred embodiment of a method of producing the liquid developer will be described.

The method of producing the liquid developer in this embodiment includes a step of preparing a dispersion liquid (water-based dispersion liquid) comprised of a water-based dispersion medium constituted of a water-based liquid and a dispersoid in the form of finely divided particles comprised of a resin material and a coloring agent described above. The dispersoid is dispersed in the water-based dispersion medium.

The method further includes an associated particle formation step of associating a plurality of particles of the dispersoid in the water-based dispersion liquid to obtain the associated particles dispersed in an associated particle dispersion liquid.

The method further includes a step of removing a liquid (solvent) contained in the associated particle dispersion liquid to obtain toner particles comprised of the resin material and the coloring agent.

The method further includes a dispersion step of dispersing the thus obtained toner particles and a cation type photopolymerization initiator as described above in an insulation liquid.

Hereinbelow, each of the steps of the method of producing the liquid developer of this embodiment will be described in detail.

Step of Preparing Dispersion Liquid (Step of Preparing Water-Based Dispersion Liquid)

First, a dispersion liquid (water-based dispersion liquid) is produced as described below.

Such a method of production of the water-based dispersion liquid is not particularly limited to a specific method. An example of such a method is described hereinbelow.

First, a resin solution containing an organic solvent and a constituent material of toner particles (toner material) which is a resin material, a coloring agent and the like is obtained by dissolving or dispersing the constituent material of the toner particles in the organic solvent (Preparation of Resin Solution).

Thereafter, a water-based liquid is added to the resin solution described above. As a result, it is possible to obtain the water-based dispersion liquid comprised of the water-based liquid (water-based dispersion medium) and the dispersoid comprised of the constituent material of the toner particles in the form of fine particles which is dispersed in the water-based liquid (Formation of Dispersoid).

Hereinafter, the method of preparing the water-based dispersion liquid will be described in detail.

Preparation of Resin Solution

First, the constituent material of the toner particles which contains the resin material is dissolved and/or dispersing in the organic solvent. As a result, the resin solution containing the organic solvent and the constituent material is obtained.

The resin solution contains the constituent material constituting the toner particles and the organic solvent as follow.

Various organic solvents may be used as long as they can dissolve a part of the resin material of the toner particles, but it is preferable to use an organic solvent having a boiling point lower than that of the water-based liquid described later. This makes it possible to remove the organic solvent from the water-based dispersion liquid easily.

Further, it is also preferred that the organic solvent has low compatibility with the water-based dispersion medium (water-based liquid) (for example, a liquid having a solubility of 30 g or lower with respect to the water-based medium of 100 g at 25° C.). This makes it possible for the toner material to be finely dispersed in the water-based dispersion liquid in a stable manner.

Further, a composition of the organic solvent can be selected appropriately according to the resin material described above, the composition of the coloring agent to be used, the composition of the water-based dispersion medium to be used or the like.

Such an organic solvent is not particularly limited to any specific kinds of solvent. Examples of such an organic solvent include ketone solvent such as methyl ethyl ketone (MEK), aromatic hydrocarbon solvent such as toluene, and the like.

Such a resin liquid can be obtained by mixing the resin material, the coloring agent, the organic solvent and the like with being stirred with an agitator and the like. Examples of such an agitator include high speed agitators such as DESPA (produced by ASADA IRON WORKS. CO., LTD), T.K. ROBOMIX/T.K. HOMO DISPER MODEL 2.5 (produced by PRIMIX Corporation).

Further, a temperature of the components constituting the resin liquid in stirring the components with the agitator is preferably in the range of 20 to 60° C., and more preferably in the range of 30 to 50° C.

An amount of a solid component contained in the resin solution is not particularly limited to a specific value, but it is preferably in the range of 40 to 75 wt %, more preferably in the range of 50 to 73 wt %, and even more preferably in the range of 50 to 70 wt %.

If the amount of the solid component falls within above noted range, it is possible to increase the degree of sphericity of the fine particles of the dispersoid in the water-based dispersion liquid described later. Namely, it is possible to form the shape of the dispersoid into an approximately spherical shape. As a result, the toner particles in the finally obtained liquid developer can have especially large roundness and especially small particle shape variation.

Further, in the preparation of the resin solution, the all components constituting the resin solution may be mixed at the same time. Furthermore, a part of the components constituting the resin solution is mixed thereby to obtain a mixture (master). Thereafter, the mixture may be mixed with the other components thereof.

Formation of Dispersoid

Next, the water-based dispersion liquid (dispersion liquid) is prepared.

The water-based dispersion medium constituted from the water-based liquid is added to the resin solution described above. As a result, a dispersoid comprised of fine particles of the toner material described above is formed in the water-based dispersion medium (water-based liquid) so that a water-based dispersion liquid (dispersion liquid) in which the dispersoid is dispersed is obtained.

In this embodiment, the water-based dispersion medium is constituted of the water-based liquid.

As the water-based liquid, a liquid constituted of water as a main component thereof can be used.

Further, the water-based liquid may contain a solvent having good compatibility with water (for example, a solvent having a solubility of 50 g or higher with respect to water of 100 g at 25° C.).

Furthermore, an emulsion dispersant may be added to the water-based dispersion medium as needed. By adding the emulsion dispersant to a water-based dispersion medium, it is possible to produce a water-based emulsion liquid more easily.

Such an emulsion dispersant is not particularly limited to a specific material, but commonly used emulsion dispersants can be used.

Further, the water-based dispersion liquid may contain a neutralizing agent in preparing the water-based dispersion liquid. By containing the neutralizing agent in the water-based dispersion liquid, the neutralizing agent can neutralize functional groups (for example, a carboxyl group or the like) contained in the resin material constituting the toner particles.

As a result, it is possible to improve dispersibility of the dispersoid. Further, it is also possible to make variations in shape and size of the dispersoid in the water-based dispersion liquid smaller, and also possible to make particle size distribution of the toner particles finally obtained especially narrow.

The neutralizing agent may be added to the water-based liquid. Further, the neutralizing agent may be added to the resin liquid. Furthermore, in preparing the water-based dispersion liquid, the neutralizing agent may be added to the water-based dispersion liquid at different timings.

As for the neutralizing agent, a basic compound may be used. More specifically, examples of such a neutralizing agent include: inorganic base such as sodium hydroxide, potassium hydroxide, ammonia, and the like; organic base such as diethylamine, triethylamine, isopropylamine, and the like. These neutralizing agents may be used singly or in combination of two or more of them. Further, the neutralizing agent may be consisted of aqueous solution containing the compounds described above.

Further, in the case where the water-based dispersion liquid contains the basic compound as the neutralizing agent, an amount of using the basic compound is preferably in the range of 1 to 3 times with respect to an amount of the basic compound which is necessary to neutralize all the carboxyl groups contained in the resin material in the water-based dispersion liquid (1 to 3 equivalent), and more preferably in the range of 1 to 2 times with respect to an amount of the basic compound (1 to 2 equivalent).

This makes it possible to make the shape of each particle of the dispersoid uniform. Further, this also makes it possible to narrow particle size distribution of the toner particles obtained in the associated particle formation step which will be described in detail.

Such a method of adding the water-based liquid to the resin solution is not particularly limited to a specific method, but it is preferred that a water-based liquid containing water is added to the resin solution with being stirred.

More specifically, it is preferred that the water-based liquid is added drop by drop to the resin solution being stirred by an agitator and the like thereby to induce phase-inversion from a water-in-oil type emulsified liquid to an oil-in-water type emulsified liquid. As a result, the water-based dispersion liquid in which the dispersoid derived from the resin liquid is dispersed in the water-based liquid (the water-based dispersion liquid) is finally obtained.

Examples of such an agitator for stirring the resin solution (preparing the water-based dispersion liquid) include high speed agitators such as DESPA (produced by ASADA IRON WORKS. CO., LTD), T.K. ROBOMIX/T.K. HOMO DISPER MODEL 2.5 (produced by PRIMIX Corporation), CAVITRON (produced by MITUI MINING. CO., LTD), Slasher (produced by EUROTECH, LTD) and the like, or high speed dispersers.

Further, in adding the water-based liquid to the resin solution, a rotational velocity of the tip of a stirring blade of the agitator described above is preferably in the range of 10 to 20 m/sec, and more preferably in the range of 12 to 18 m/sec. If the rotational velocity falls within above noted range, it is possible to produce the water-based dispersion liquid efficiently.

Further, it is also possible to make variations in shape and size of the dispersoid in the water-based dispersion liquid especially small. Furthermore, it is also possible to prevent the dispersoid in the water-based dispersion liquid from being formed into excessively fine particles or coarsened particles, and also possible to improve dispersibility of the dispersoid.

An amount of the solid component contained in the water-based dispersion liquid is not particularly limited to a specific value, but it is preferably in the range of 5 to 55 wt %, and more preferably in the range of 10 to 50 wt %. This makes it possible to prevent bonding or aggregation of the dispersoid in the water-based dispersion liquid more reliably, thereby enabling productivity of the toner particles (liquid developer) to be especially excellent.

Further, a temperature of the components constituting the water-based dispersion liquid in stirring the components with the agitator is preferably in the range of 20 to 60° C., and more preferably in the range of 20 to 50° C.

Associated Particle Formation Step

Next, a plurality of fine particles of the dispersoid in the water-based dispersion liquid are associated so that associated particles dispersed in an associated particle dispersion liquid is obtained (Associated particle formation step). Association of the fine particles of the dispersoid is generally carried out by allowing fine particles of the dispersoid containing organic solvent conflicting with each other and thereby each of fine particles of the dispersoid being integrated.

The association of a plurality of dispersoid is carried out by adding an electrolyte to the water-based dispersion liquid obtained by the processes as described above with being stirred. This makes it possible to obtain the associated particles easily and reliably. Further, by controlling an additive amount of the electrolyte into the water-based dispersion liquid, it is possible to control a particle size and a particle size distribution of the associated particles easily and reliably.

Such an electrolyte is not particularly limited to any specific kinds of electrolyte, but organic or inorganic soluble salts may be used singly or in combination of two or more of them.

Further, it is preferred that such an electrolyte is a salt of monovalent cation. This makes it possible to make particle size distribution of the associated particles narrow. Further, by using the salt of the monovalent cation, it is possible to prevent coarsened particles from being produced in the process of associating the fine particles of the dispersoid.

Among the above-mentioned electrolytes, a sulfate salt such as sodium sulfate, ammonium sulfate and the like, and a carbonate are preferably used as the electrolyte, and the sulfate salt are especially preferably used. This makes it possible to control a particle size of the associated particles especially easily.

An amount of the electrolyte to be added is preferably in the range of 0.5 to 3 parts by weight, more preferably in the range of 1 to 2 parts by weight with respect to 100 parts by weight of the solid component contained in the dispersion liquid (water-based dispersion liquid) to be added the electrolyte.

This makes it possible to control a particle size of the associated particles more reliably. Further, it is possible to also prevent production of coarsened particles reliably.

Further, it is preferred that a solution of the electrolyte is added to the water-based dispersion liquid. This makes it possible to make electrolyte diffuse in the whole water-based dispersion liquid quickly. Furthermore, it is also possible to control an amount of the electrolyte to be added to the water-based dispersion liquid easily and reliably. As a result, it is possible to obtain the associated particles having a desired particle size and especially narrow particle size distribution.

Further, in the case where the solution of the electrolyte is added to the water-based dispersion liquid, concentration of the electrolyte contained in the solution is preferably in the range of 2 to 10 wt %, and more preferably in the range of 2.5 to 6 wt %. This makes it possible to make the electrolyte diffuse in the whole water-based dispersion liquid especially quickly.

Furthermore, it is also possible to control the amount of the electrolyte to be added to the water-based dispersion liquid easily and reliably. In addition, by adding the solution to the water-based dispersion liquid, the amount of water contained in the water-based dispersion liquid after adding the solution of the electrolyte can be adjusted appropriately.

As a result, a growth rate of the associated particles after adding the electrolyte to the water-based dispersion liquid can be appropriately adjusted to be slow without lowering the productivity. This makes it possible to control a particle size of the associated particles more reliably. Further, it is also possible to prevent coarsened particles from being produced in the water-based dispersion liquid.

Further, in the case where the solution of the electrolyte is added to the water-based dispersion liquid, a rate of adding the solution of the electrolyte to the water-based dispersion liquid is preferably in the range of 0.5 to 10 parts by weight/min, more preferably in the range of 1.5 to 5 parts by weight/min with respect to 100 parts by weight of the solid component contained in the water-based dispersion liquid.

This makes it possible to prevent the concentration of the electrolyte in the whole water-based dispersion liquid from being inhomogeneous. As a result, it is possible to prevent production of coarsened particles reliably. Furthermore, it is possible to make the particle size distribution of the associated particles especially narrow.

Further, by adding the electrolyte to the water-based dispersion liquid at such a speed, it is possible to control the growth rate of the associated particles more appropriately. As a result, it is possible to control an average particle size of the associated particles more reliably, thereby enabling productivity of the toner particles (liquid developer) to be especially excellent.

Further, the electrolyte may be added to the water-based dispersion liquid at different timings. This makes it possible to obtain associated particles having a desired particle size and large roundness (sphericity) reliably.

Further, in the step of forming the associated particles, the associated particles in the associated particle dispersion liquid are produced in a state that the water-based dispersion liquid is stirred by an agitator. This makes it possible to make variations in a shape and size of the associated particles in the associated particle dispersion liquid especially small.

Such an agitator for stirring the associated particle dispersion liquid may be equipped with a stirring blade. Examples of such a stirring blade include anchor type stirring blade, turbine blade, Pfaudler blade, FULLZONE impeller, maxblend stirring blade, and semi-lunar blade. Among the above-mentioned stirring blades, maxblend stirring blade and FULLZONE impeller are preferably used as a stirring blade.

This makes it possible to make the electrolyte disperse and dissolve in the water-based dispersion liquid (the associated particle dispersion liquid) more quickly and more homogeneously. Namely, this makes it possible to prevent the concentration of the electrolyte in the water-based dispersion liquid from being inhomogeneous reliably.

Further, it is possible to prevent the associated particles that have been already formed from being collapsed more reliably, while effectively associating the dispersoid. As a result, it is possible to obtain associated particles having small variations in shape and size thereof efficiently.

In the step of forming the associated particles, a rotational velocity of the tip of the stirring blade of the agitator described above is preferably in the range of 0.1 to 10 m/sec, more preferably in the range of 0.2 to 8 m/sec, and even more preferably in the range of 0.2 to 6 m/sec.

If the rotational velocity falls within above noted range, it is possible to make the electrolyte disperse and dissolve in the water-based dispersion liquid (the associated particle dispersion liquid) more quickly and more homogeneously. Namely, this makes it possible to prevent the concentration of the electrolyte in the water-based dispersion liquid from being inhomogeneous reliably.

Further, it is possible to prevent the associated particles that have been already formed from being collapsed more reliably, while effectively associating the dispersoid.

An average particle size of the obtained associated particles is preferably in the range of 0.5 to 5 μm, and more preferably in the range of 1.5 to 3 μm. This enables the toner particles finally obtained to have an appropriate particle size.

Step of Removing Solvent in Associated Particle Dispersion Liquid

Next, the organic solvent contained in the associated particle dispersion liquid is removed. This makes it possible to obtain resin fine particles (toner particles) dispersed in the associated particle dispersion liquid in which the organic solvent is removed.

Such a method of removing the organic solvent from the associated particle dispersion liquid is not particularly limited to a specific method, but for example, it may be carried out by drying the associated particle dispersion liquid under reduced pressure. This makes it possible to prevent the constituent material of the toner particles (that is the resin material) from denaturing sufficiently and also makes it possible to remove the organic solvent efficiently.

Further, a temperature to remove the organic solvent contained in the associated particle dispersion liquid is preferably lower than a glass transition temperature (Tg) of the resin material which constitutes the associated particles.

Further, in this step of removing the organic solvent contained in the associated particle dispersion liquid, an antifoaming agent may be added to the associated particle dispersion liquid. This makes it possible to remove the organic solvent efficiently.

Examples of an antifoaming agent include a mineral oil type antifoaming agent, a polyether type antifoaming agent, a silicone type antifoaming agent, lower alcohol, higher alcohol, fat, a fatty acid, fatty acid ester, ester phosphate and the like.

An amount of the antifoaming agent to be added the associated particle dispersion liquid is not particularly limited to a specific value, but an amount of the antifoaming agent is preferably in the range of 20 to 300 ppm, and more preferably in the range of 30 to 100 ppm with respect to the solid component contained in the associated particle dispersion liquid.

Further, in this step of removing the organic solvent contained in the associated particle dispersion liquid, at least a part of the water-based liquid may be removed together with the organic solvent.

In this regard, in this step of removing the organic solvent contained in the associated particle dispersion liquid, a part of the organic solvent may remain in the associated particle dispersion liquid. Even if a part of the organic solvent remains in the associated particle dispersion liquid, the organic solvent contained in the associated particle dispersion liquid is completely removed in the later step.

Step of Washing

Next, the resin fine particles constituted of the toner material obtained as described above are washed (Step of Washing).

By carrying out the step of washing the toner particles, even if the resin fine particles contain the organic solvent, which has not yet been removed in the previous step, and the like as impurities, the organic solvent and the like contained in the resin fine particles is completely removed in this step. As a result, the resin fine particles finally obtained have an especially small amount of total volatile organic compounds (TVOC).

Such a method of washing the toner particles is carried out as follow. First, the slurry mainly containing the resin fine particles and the water-based liquid is separated into a solid content (the resin fine particles) and a liquid content.

Thereafter, the solid content separated from the slurry is dispersed into water to thereby obtain new slurry (redispersion step). Further, once more, the thus obtained slurry is separated into a solid content (the resin fine particles) and a liquid content. Further, the separation step and the redispersion step may be repeated more than once.

Step of Drying

Thereafter, the resin fine particles constituted of the toner material washed as described above are dried to thereby obtain toner particles (step of drying).

In this step of drying the resin fine particles, such resin fine particles can be dried by a drying machine. Examples of such a drying machine include a vacuum drier (for example, "Ribocone" produced by Okawara Manufacturing, "Vrieco-Nauta Mixer NXV Vacuum" produced by HOSOKAWA MICRON CORPORATION, and the like), a fluid-bed drier (produced by OKAWARA MFG. Co., Ltd), and the like.

Dispersion Step

Next, the thus obtained toner particles and a cation type photopolymerization initiator are dispersed in an insulation liquid. As a result, the liquid developer of the present invention is obtained (dispersion step).

A constituent material of each of the cation type photopolymerization initiator and the insulation liquid can use the same material as described above.

Such a method of dispersing the toner particles and the cation type photopolymerization initiator in the insulation liquid is not particularly limited to a specific method, but for example, it may be carried out by mixing all the toner particles, the cation type photopolymerization initiator, and the insulation liquid with bead mill, ball mill, and the like. By using such a method, it is possible to obtain a liquid developer in which the toner particles and the cation type photopolymerization initiator are uniformly dispersed in the insulation liquid.

Further, in this step of dispersing the toner particles and the cation type photopolymerization initiator in the insulation liquid, additional components constituting the liquid developer other than the toner particles, the cation type photopolymerization initiator, and the insulation liquid may be mixed together.

Further, in this step of dispersing the toner particles and the cation type photopolymerization initiator in the insulation liquid, the toner particles and the cation type photopolymerization initiator may be dispersed in the whole of the insulation liquid used in the liquid developer. Alternatively, the toner particles and the cation type photopolymerization initiator may be dispersed in a part of the insulation liquid used in the liquid developer.

In the case where the toner particles and the cation type photopolymerization initiator are dispersed in a part of the insulation liquid used in the liquid developer, the remaining insulation liquid to be added after dispersion of the toner particles and the cation type photopolymerization initiator may be the same kind of the insulation liquid that has been already used.

Alternatively, the remaining insulation liquid to be added after dispersion of the toner particles and the cation type photopolymerization initiator may be a different kind of the insulation liquid that has been already used. In the latter case, it is possible to control the physical characteristics such as a viscosity of the liquid developer finally obtained easily.

By using the method of producing the liquid developer as described above, it is possible to obtain toner particles of which constituent material is uniformly dispersed in the insulation liquid. Further, this makes it possible to make variations in shape and size of the toner particles in the liquid developer small. As a result, the surface area of each of the toner particles is uniform among the toner particles.

Further, it is possible to uniformly dissolve the cation type photopolymerization initiator in the liquid developer. Furthermore, it is possible to obtain superior preservability or storage stability of the liquid developer. Furthermore, it is possible to quickly and firmly fix the unfixed toner image (liquid developer) onto the recording medium.

Method of Forming Image and Image Forming Apparatus

First Embodiment

Next, a description will be made with regard to a first embodiment of a method of forming an image of the present invention. The method of forming the image of the present invention is carried out by forming a color image (toner image) on a recording medium using the liquid developer of the present invention as described above.

Concretely, the method of forming the image according to the this embodiment includes a developing step, a transferring step, and a fixing step.

The developing step is a step in which monochromatic images corresponding to respective colors are formed on photoreceptors of respective colors of an image forming apparatus by using the liquid developers of the respective colors as described above, respectively.

The transferring step is a step in which the monochromatic images corresponding to the respective colors are transferred on an intermediate transfer section of the image forming apparatus, respectively, and then an unfixed toner image obtained by overlaying each of the monochromatic images on the intermediate transfer section is formed on the recording medium (intermediate transferring step and secondary transferring step).

The fixing step is a step in which the unfixed toner image is fixed on the recording medium by irradiating an ultraviolet ray thereto to obtain a fixed toner image.

Hereinafter, a description will be made on the method of forming the image according to this embodiment with reference to an image forming apparatus.

Figure 2:
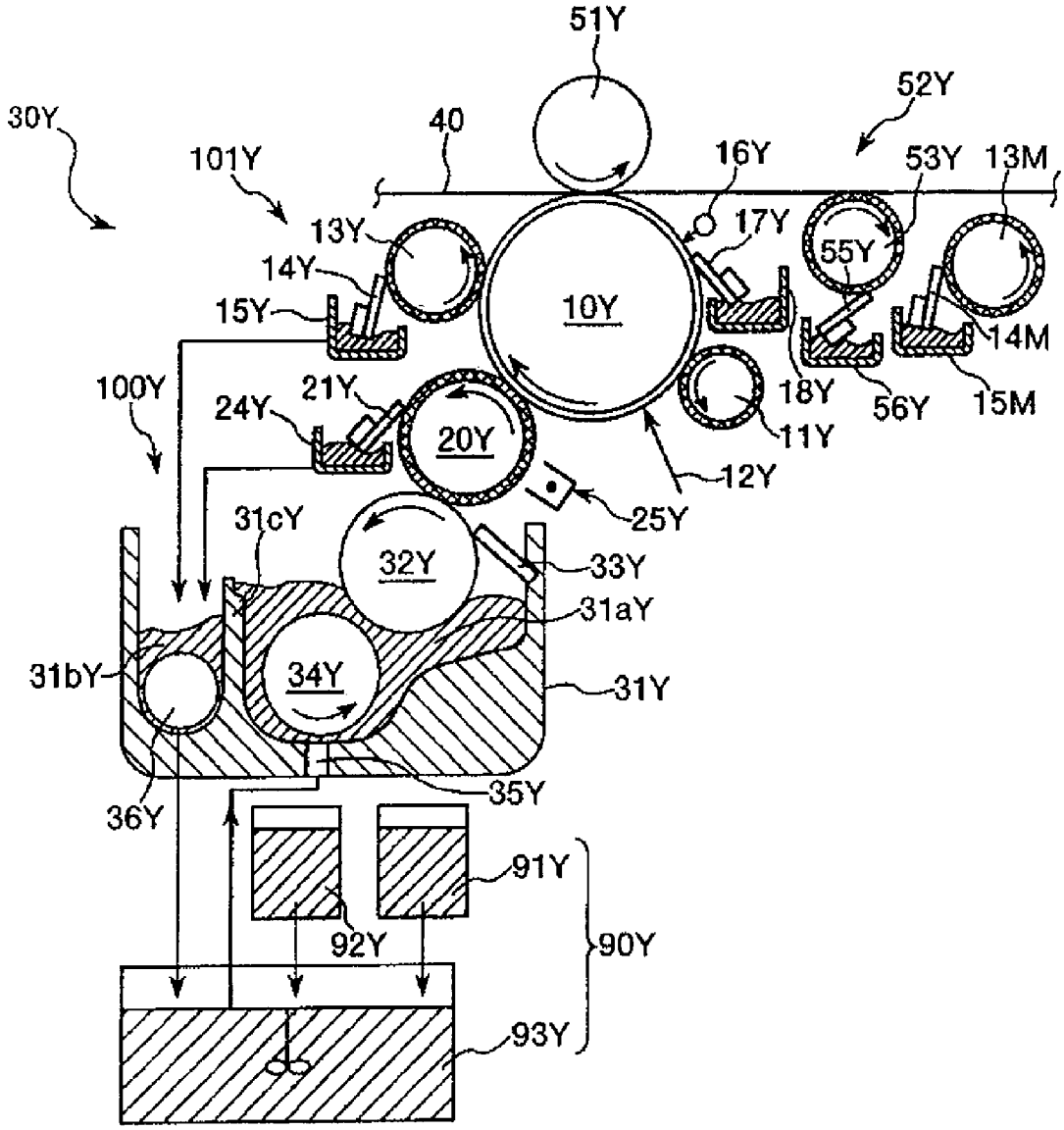
FIG. 2 is an enlarged view of a part of the image forming apparatus shown in FIG. 1.
Figure 3:
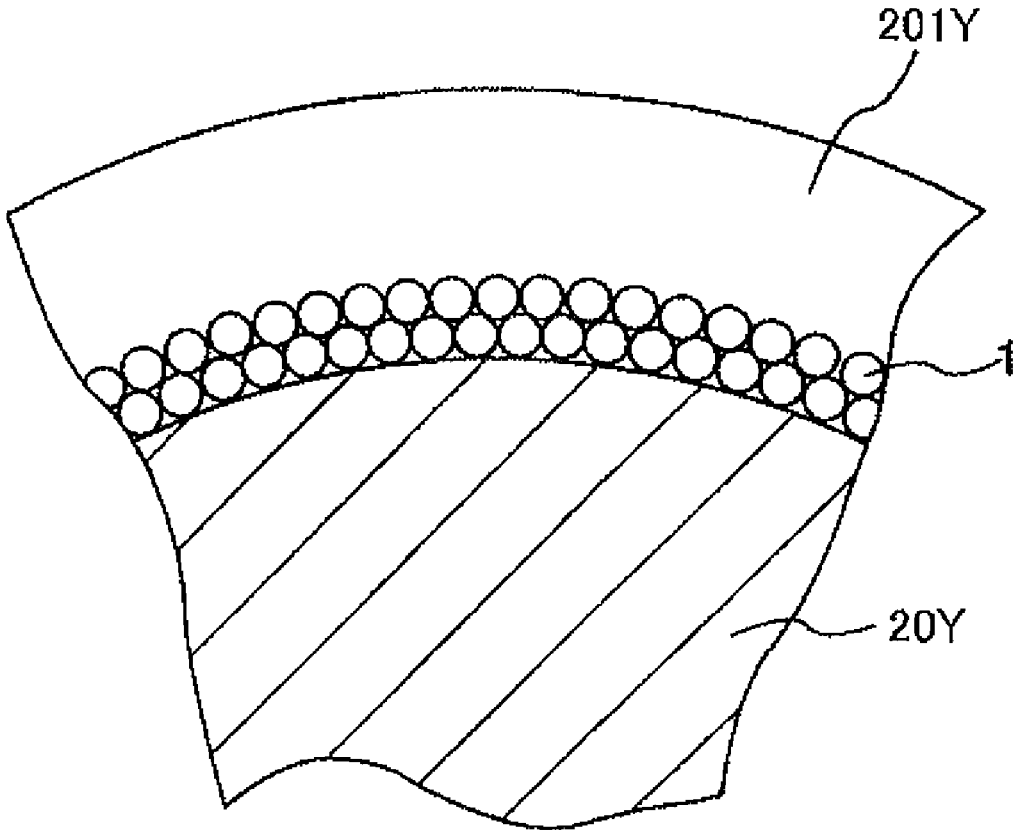
FIG. 3 is a schematic view which shows a state of toner particles in a layer of a liquid developer on a developing roller of the image forming apparatus shown in FIG. 1.

FIG. 1 is a schematic view which shows a preferred embodiment of an image forming apparatus that can be used to a first embodiment of a method of forming an image of the present invention. FIG. 2 is an enlarged view of a part of the image forming apparatus shown in FIG. 1. FIG. 3 is a schematic view which shows a state of toner particles in a layer of the liquid developer on a developing roller of the image forming apparatus shown in FIG. 1.

As shown in FIG. 1 and FIG. 2, the image forming apparatus 1000 includes four developing sections comprised of 30Y, 30C, 30M and 30K, an intermediate transfer section 40, a secondary transfer unit (secondary transfer section) 60, an ultraviolet emitting means (fixing unit) F40 and four liquid developer supply sections 90Y, 90M, 90C and 90K.

The developing sections 30Y, 30C and 30M include respectively a yellow (Y) liquid developer, a cyan (C) liquid developer, and a magenta (M) liquid developer, and have functions of developing latent images with the liquid developers to form monochromatic color images corresponding to the respective colors. Further, the developing section 30K includes a black (K) liquid developer, and has a function of developing a latent image with the liquid developer to form a black monochromatic image.

The developing sections 30Y, 30C, 30M and 30K have the same structure. Therefore, in the following, the developing section 30Y will be representatively described.

As shown in FIG. 2, the developing section 30Y includes a photoreceptor 10Y which carries a latent image and rotates in the direction of the arrow shown in the drawings. The developing section 30Y further includes an electrifying roller 11Y, an exposure unit 12Y, a developing unit 100Y, a photoreceptor squeeze device 101Y, a primary transfer backup roller 51Y, an electricity removal unit 16Y, a photoreceptor cleaning blade 17Y, and a developer collecting section 18Y, and they are arranged in the named order along the rotational direction of the photoreceptor 10Y.

The photoreceptor 10Y includes a cylindrical conductive base member and a photosensitive layer (both not shown in the drawings) which is constituted of a material such as amorphous silicon or the like formed on the outer peripheral surface of the base member, and is rotatable about the axis thereof in the clockwise direction as shown by the arrow in FIG. 2.

The liquid developer is supplied onto the surface of the photoreceptor 10Y from the developing unit 100Y so that a layer of the liquid developer is formed on the surface thereof. That is to say, a monochromatic image is developed on the surface of the photoreceptor 10Y (developing step).

The electrifying roller 11Y is a device for uniformly electrifying the surface of the photoreceptor 10Y. The exposure unit 12Y is a device that forms an electrostatic latent image on the photoreceptor 10Y uniformly by means of laser beam irradiation.

The exposure unit 12Y includes a semiconductor laser, a polygon mirror, an F-θ lens, or the like, and irradiates a modulated laser beam onto the electrified photoreceptor 10Y in accordance with image signals received from a host computer such as a personal computer, a word processor or the like not shown in the drawings.

The developing unit 100Y is a device which develops the latent image to be visible with the liquid developer of the present invention. The details of the developing unit 200Y will be described later.

The photoreceptor squeeze device 101Y is disposed so as to face the photoreceptor 101Y at the downstream side of the developing unit 100Y in the rotational direction thereof. The photoreceptor squeeze device 101Y is composed from a photoreceptor squeeze roller 13Y, a cleaning blade 14Y which is press contact with the photoreceptor squeeze roller 13Y for removing a liquid developer adhering to the surface of the photoreceptor squeeze roller 13Y, and a developer collecting section 15Y for collecting the removed liquid developer.

The photoreceptor squeeze device 101Y has a function of collecting an excess carrier (insulation liquid) and a fog toner which is inherently unnecessary from the liquid developer developed by the photoreceptor 10Y, thereby increasing a ratio of the toner particles in the image to be formed.

The primary transfer backup roller 51Y is a device for transferring a monochrome toner image formed on the photoreceptor 10Y to the intermediate transfer section (belt) 40.

The electricity removal unit 16Y is a device for removing a remnant charge on the photoreceptor 10Y after an intermediate image has been transferred to the intermediate transfer section 40 by the primary transfer backup roller 51Y.

The photoreceptor cleaning blade 17Y is a member made of rubber and provided in contact with the surface of the photoreceptor 10Y, and has a function of scrapping off the liquid developer remaining on the photoreceptor 10Y after the image has been transferred onto the intermediate transfer section 40 by the primary transfer backup roller 51Y.

The developer collecting section 18Y is provided for collecting the liquid developer removed by the photoreceptor cleaning blade 17Y.

The intermediate transfer section 40 is composed from an endless elastic belt which is wound around a belt drive roller 41 to which driving force is transmitted by a motor not shown in the drawings, a pair of driven rollers 44 and 45, and a tension roller 49. The intermediate transfer section 40 is rotationally driven in the anticlockwise direction by the belt drive roller 41 while being in contact with the photoreceptors 10Y, 10M, 10C and 10K at each of positions that the primary transfer backup rollers 51Y, 51C, 51M and 51K are in contact with an intermediate transfer belt (feed belt).

The intermediate transfer section 40 is constructed so that a predetermined tension is given by the tension roller 49 to prevent loosening of the endless elastic belt. The tension roller 49 is disposed at the downstream side of the intermediate transfer section 40 in the moving direction thereof with respect to one driven roller 44 and at the upstream side of the intermediate transfer section 40 in the moving direction thereof with respect to the other driven roller 45.

Monochromatic images corresponding to the respective colors formed by the developing sections 30Y, 30C, 30M and 30K are sequentially transferred by the primary transfer backup rollers 51Y, 51C, 51M and 51K so that the monochromatic images corresponding to the respective colors are overlaid, thereby enabling a full color toner image (intermediate transferred image) to be formed on the intermediate transfer section 40 which will be described later.

The intermediate transfer section 40 carries the monochromatic images formed on the respective photoreceptors 10Y, 10M, 10C and 10K in a state that these images are successively secondary-transferred onto the belt so as to be overlaid one after another, and the overlaid images are transferred onto a recoding medium F5 such as papers film and cloth as a single color image in the secondary transfer unit 60 described later.

In the meantime, when the toner image is transferred onto the recording medium F5 in the secondary transfer process, there is a case that the recording medium F5 is not a flat sheet material due to fibers thereof. The elastic belt is employed as a means for increasing a secondary transfer characteristic for such a non-flat sheet material.

Further, the intermediate transfer section 40 is also provided with a cleaning device which is composed form an intermediate transfer section cleaning blade 46, a developer collecting section 47 and a non-contact type bias applying member 48. The intermediate transfer section cleaning blade 46 and the developer collecting section 47 are arranged on the side of the driven roller 45.

The intermediate transfer section cleaning blade 46 has a function of scrapping off of the liquid developer adhering to the intermediate transfer section 40 to remove it after the image has been transferred onto a recording medium F5 by the secondary transfer unit (secondary transfer section) 60.

The developer collecting section 47 is provided for collecting the liquid developer removed by the intermediate transfer section cleaning blade 46.

The non-contact type bias applying member 48 is disposed so as to be apart from the intermediate transfer section 40 at an opposite position of the tension roller 49 through the intermediate transfer section (that is, elastic belt) 40.

The non-contact type bias applying member 48 applies a bias voltage having a reversed polarity with respect to a polarity of the toner particles to each of the toner particles (solid content) contained in the liquid developer remaining on the intermediate transfer section 40 after the image has been secondary-transferred onto the recording medium F5.

This makes it possible to remove electricity from the remaining toner particles so that it is possible to lower electrostatic adhesion force of the toner particles to the intermediate transfer section 40. In this embodiment, a corona electrification device is used as the non-contact type bias applying member 48.

In this regard, it is to be noted that the non-contact type bias applying member 48 may not be necessarily disposed at the opposite position of the tension roller 49 through the intermediate transfer section (that is, elastic belt) 40.

For example, the non-contact type bias applying member 48 may be disposed at any position between the downstream side of the intermediate transfer section 40 in the moving direction thereof with respect to one driven roller 44 and the upstream side of the intermediate transfer section 40 in the moving direction thereof with respect to the other driven roller 45 such as any position between the driven roller 44 and the tension roller 49.

Note that as the non-contact type bias applying member 48, various known non-contact type electrification devices other than the corona electrification device may be employed.

An intermediate transfer squeeze device 52Y is provided at the downstream side of the primary transfer backup roller 51Y in the moving direction of the intermediate transfer section 40 (see FIG. 2).

The intermediate transfer squeeze device 52Y is provided as a means for removing an excess amount of the insulation liquid from the transferred liquid developer in the case where the liquid developer transferred onto the intermediate transfer section 40 does not have a desired dispersion state.

As shown in FIG. 2, the intermediate transfer squeeze device 52Y includes an intermediate transfer squeeze roller 53Y, an intermediate transfer squeeze roller cleaning blade 55Y which is in press contact with the intermediate transfer squeeze roller 53Y for cleaning the surface thereof, and a liquid developer collecting section 56Y which collects the liquid developer removed from the intermediate transfer squeeze roller 53Y by the intermediate transfer squeeze roller cleaning blade 55Y.

The intermediate transfer squeeze device 52Y has a function of collecting an excess carrier (insulation liquid) from the liquid developer primary-transferred to the intermediate transfer section 40 to increase a ratio of the toner particles in an image to be formed and collecting a fog toner which is inherently unnecessary.

The secondary transfer unit 60 is provided with a pair of secondary transfer rollers 64 and 65 which are arranged so as to depart from each other for a predetermined distance along the moving direction of the recording medium F5. Among the pair of the secondary transfer rollers 64 and 65, the upstream side secondary transfer roller 64 is arranged upstream side of the intermediate transfer section 40 in the rotational direction thereof. This upstream side secondary transfer roller 64 is capable of being in press contact with the belt drive roller 41 through the intermediate transfer section 40.

Among the pair of the secondary transfer rollers 64 and 65, the downstream side secondary transfer roller 65 is arranged at the downstream side of a recording medium F5 in the moving direction thereof. This downstream side secondary transfer roller 65 is capable of being in press contact to the recording medium F5 with the driven roller 44 through the intermediate transfer section 40.

Namely, intermediate transfer images, which are formed on the intermediate transfer section 40 by overlaying the transferred monochromatic color images in a state that the recording medium F5 is in contact with the intermediate transfer section 40 which wound around the belt drive roller 41 and the driven roller 44 and goes through between the driven roller 44 and the downstream side secondary transfer roller 65 and between the belt driven roller 41 and the upstream side secondary transfer roller 64, are secondary-transferred on the recording medium F5 (secondary transferring step).

In this case, the belt driven roller 41 and the driven roller 44 have functions as the upstream side secondary transfer roller 64 and the downstream side secondary transfer roller 65, respectively.

Namely, the belt driven roller 41 is also used as an upstream side backup roller arranged at the upstream side of the recording medium F5 to the driven roller 44 in the moving direction thereof in the secondary transfer unit 60.

The driven roller 44 is also used as a downstream side backup roller arranged in the downstream side of the recording medium F5 to the belt driven roller 41 in the moving direction thereof in the secondary transfer unit 60.

The recording medium F5 which have been conveyed to the secondary transfer unit 60 is allowed to adhere to the intermediate transfer belt (section 40) at positions between the upstream side secondary transfer roller 64 and the belt driven roller 41 (nip starting position) and between the downstream side secondary transfer roller 65 and the driven roller 44 (nip ending position).

Since this makes it possible to secondary-transfer the intermediate transfer images of a full color on the intermediate transfer section 40 to the recording medium F5 with adhesion to the intermediate transfer section 40 for a predetermined period of time, it is possible to secondary-transfer the intermediate images reliably.

The secondary transfer unit 60 is provided with a secondary transfer roller cleaning blade 66 and a developer collecting section 67 with respect to the upstream side secondary transfer roller 64. The secondary transfer unit 60 is also provided with a secondary transfer roller cleaning blade 68 and a developer collecting section 69 with respect to the downstream side secondary transfer roller 65.

Each of the secondary transfer roller cleaning blades 66 and 68 is in contact with the respective secondary transfer rollers 64 and 65 to clean them. Namely, after the completion of the secondary-transfer, the liquid developer remaining on the surfaces of each of the secondary transfer rollers 64 and 65 is scrapped off by the secondary transfer roller cleaning blades 66 and 68 and removed from the secondary transfer rollers 64 and 65.

The liquid developer scrapped off from the surfaces of each of the respective secondary transfer rollers 64 and 65 by each of the secondary transfer roller cleaning blades 66 and 68 is collected and preserved by each of the developer collecting sections 67 and 69.

A toner image (transferred image) F5*a* transferred onto the recording medium F5 by the secondary transfer section 60 is fed to an ultraviolet emitting means (fixing device) F40 (which will be described later), where the unfixed toner image is fixed onto the recoding medium F5 (fixing step).

The ultraviolet emitting means F40 has a function that emits (irradiates) an ultraviolet ray to a surface of the recording medium F5 fed out as described above, the surface on which the toner image F5*a* is formed.

Further, owing to the irradiation of the ultraviolet ray from the ultraviolet emitting means F40 to the toner image F5*a*, the insulation liquid contained in the liquid developer constituting the toner image F5*a* is solidified. This makes it possible to firmly fix the toner particles onto the recording medium F5. As a result, it is possible to improve fixing strength of the toner image F5*a* to the recording medium F5. This fixing step is one feature in the method of forming the image according to the present invention.

In the present invention, if energy beam such as an ultraviolet ray or the like is irradiated to the toner image F5*a* (liquid developer), the cation type photopolymerization initiator included therein is sensitivity reacted (activated), and then the insulation liquid contained in the liquid developer of the toner image F5*a* is quickly solidified.

Therefore, it is possible to significantly reduce a time needed to the fixing step as compared to a thermo fixing process in which toner particles are fused by heat, thereby fixing the toner particles to a recording medium, which is used as a conventional technology.

This means that since it does not take so long time for the fixing process, it is possible to speed up a printing speed further. Further, a large amount of heat is not required for the fixing step, it is possible to save energy.

In the method of forming the image according to the present invention, the toner image F5*a* can be fixed the toner image F5*a* to the recording medium F5 in a non-contact state. In this way, the obtained tone image F5*a* becomes clear with no bleeding as compared to a case where a toner image is fixed to a recording medium in a contact state (e.g. the toner image is fixed to the recording medium while pressing a heated roller to the toner image).

An energy of the ultraviolet ray irradiated from the ultraviolet emitting means F40 is preferably in the range of 35 to 500 mJ/cm$^2$, and more preferably in the range of 40 to 500 mJ/cm$^2$. This makes it possible to reliably active the cation type photopolymerization initiator contained in the liquid developer, and therefore the modified epoxy compound is efficiently polymerized and cured. As a result, it is possible to firmly fix the toner image F5*a* to the recording medium F5 at a short time.

Further, a feeding speed of the recording medium F5 (toner image F5*a*) in the ultraviolet emitting means F40 is preferably in the range of 50 to 1000 mm/sec, and more preferably in the range of 200 to 700 mm/sec. In the method of forming the image using the liquid developer according to the present invention, by setting the feeding speed within above noted range, it is possible to firmly fix the toner image F5*a* to the recording medium F5.

Furthermore, in the ultraviolet emitting means F40, means for heating and pressuring the unfixed toner image F5*a* may be provided. This makes it possible to further improve fixing strength of the toner image F5*a* to the recording medium F5.

In the case where the toner image F5*a* is heated, a heating temperature is preferably in the range of 70 to 160° C., more preferably in the range of 100 to 150° C., and even more preferably in the range of 100 to 140° C.

Next, a detailed description will be made with regard to the developing units 100Y, 100C, 100M and 100K. In this regard, it is to be noted that since the developing units 100Y, 100C, 100M and 100K have the same structure, in the following description the developing section 100Y will be representatively described.

As shown in FIG. 2, the developing unit 100Y includes a liquid developer storage section 31Y, an application roller 32Y, a regulating blade 33Y, a liquid developer stirring roller 34Y, a communicating section 35Y, a collecting screw 36Y, a developing roller 20Y, a developing roller cleaning blade 21Y and a corona electrification device (pressing means) 25Y.

The liquid developer storage section 31Y is provided for storing a liquid developer for developing a latent image formed on the photoreceptor 10Y.

Such a liquid developer storage section 31Y includes a supply section 31*a*Y for supplying the liquid developer onto the application roller 32Y, a collecting section 31*b*Y for collecting an excess liquid developer in the supply section 31*a*Y, the developer collecting section 15Y and a developer collecting section 24Y and a partition 31*c*Y for partitioning between the supply section 31*a*Y and the collecting section 31*b*Y.

The supply section 31*a*Y is provided for supplying the liquid developer onto the application roller 32Y and has a concave portion in which a liquid developer stirring roller 34Y is provided. Further, the liquid developer is supplied from the liquid developer mixing bath 93Y to the supply section 31*a*Y through the communicating section 35Y.

The collecting section 31*b*Y is provided for collecting the liquid developer excessively supplied to the supply section 31*a*Y and the excess liquid developer collected in the developer collecting sections 15Y and 24Y. The collected liquid developer is fed to the liquid developer mixing bath 93Y as described later and it is then reused.

Further, the collecting section 31*b*Y has a concave portion in which the collecting screw 36Y is provided in the vicinity of a bottom thereof.

A wall-like partition 31*c*Y is provided between the supply section 31*a*Y and the collecting section 31*b*Y. The wall-like partition 31*c*Y can partition between the supply section 31*a*Y and the collecting section 31*b*Y. And the partition 31*c*Y can prevent the liquid developer collected in the developer collecting sections 15Y and 24Y from being mixed to the flesh liquid developer in the supply section 31*a*Y.

When the liquid developer is excessively supplied from the liquid developer mixing bath 93Y to the supply section 31*a*', the excess liquid developer is spilled from the supply section 31*a*Y into the collecting section 31*b*Y over the partition 31*c*Y. Therefore, it is possible to maintain a constant amount of the liquid developer in the supply section 31*a*Y, thereby maintaining a constant amount of the liquid developer to be supplied to the application roller 32Y. As a result, it becomes possible to provide a constant image quality of the finally obtained images.

Further, a notch is provided in the partition 31*c*Y. The liquid developer in the supply section 31*a*Y can spill from the supply section 31*a*Y into the collecting section 31*b*Y over the notch.

The application roller 32Y has a function of supplying the liquid developer to the developing roller 20Y.

The application roller 32Y is of the type so-called as "Anilox Roller" which is constructed from a metallic roll made of iron or the like of which surface has grooves formed regularly and helically, and a nickel plating formed on the surface thereof.

The diameter of the roller is about 25 mm. As described above embodiment, in this embodiment, a number of grooves 32Y are formed inclinedly with respect to the rotational direction by means of a cutting process or rolling process.

The application roller 32Y rotates in an anti-clockwise direction and makes contact with the liquid developer so that the liquid developer stored in supply section 31*a*Y is carried by the grooves, and the carried liquid developer is then conveyed to the developing roller 20Y.

The regulating blade 33Y is provided in contact with the surface of the application roller 32Y for regulating an amount of the liquid developer carried on the application roller 32Y. Specifically, the regulating blade 33Y scrapes away an excess amount of the liquid developer on the application roller 32Y so that an amount of the liquid developer to be supplied onto the developing roller 20Y by the application roller 32Y can be regulated.

The regulating blade 33Y is formed from an elastic body made of an urethane rubber, and supported by a regulating blade supporting member made of a metal such as iron or the like. Further, the regulating blade 33Y is arranged on the side where the application roller 32Y comes out of the liquid developer with its rotation (that is, on the right side in FIG. 2).

In this regard, it is to be noted that the rubber hardness of the regulating blade 33Y, that is, a rubber hardness (77) of a portion of the regulating blade 33Y which is in press contact with the surface of the application roller 32Y is about 77 according to JIS-A.

The rubber hardness (77) of the regulating blade 33Y is lower than the rubber hardness of an elastic layer of the developing roller 20Y (described later) which is a rubber hardness (about 85) of a portion of the developing roller 20Y which is in press contact with the surface of the application roller 32Y.

Further, an excess amount of the liquid developer scraped off by the regulating blade 33Y is collected in supply section 31*a*Y and it is then reused.

The liquid developer stirring roller 34Y has a function of stirring the liquid developer so as to be homogeneously dispersed. By providing such a liquid developer stirring roller 34Y, even when a plurality of toner particles 1 are aggregated in the liquid developer storage section 31Y (supply section 31*a*Y), it is possible to disperse the plurality of toner particles 1 reliably.

In the supply section 31*a*Y, the plurality of toner particles 1 of the liquid developer are positively charged. The liquid developer is stirred by the liquid developer stirring roller 34Y to be a homogeneously dispersed state, and such a liquid developer is dipped from the liquid developer storage section 31Y (supply section 31*a*Y) according to the rotation of the application roller 32Y so that the liquid developer is supplied onto the developing roller 20Y with the amount of the liquid developer being regulated by the regulating blade 33Y.

Further, the stirring by the liquid developer stirring roller 34Y makes it possible to reliably supply the liquid developer in the supply section 31*a*Y to the collecting section 31*b*Y over the notch. Therefore, it is possible to prevent an excess amount of the liquid developer from remaining in the supply section 31*a*Y. It is also possible to prevent the toner particles contained in the liquid developer from aggregating in the supply section 31*a*Y.

Furthermore, the liquid developer stirring roller 34Y is provided in the supply section 31*a*Y in the vicinity of the communicating section 35Y. Therefore, it is possible to quickly diffuse the liquid developer supplied from the liquid developer mixing bath 93Y through the communicating section 35Y.

As a result, even in the case where the liquid developer is being supplied from the liquid developer mixing bath 93Y to the supply section 31*a*Y, it is possible to maintain the stable surface of the liquid developer in the supply section 31*a*Y.

Since such a liquid developer stirring roller 34Y is provided in the supply section 31*a*Y in the vicinity of the communicating section 35Y, a pressure in the supply section 31*a*Y is lower than a pressure in the liquid developer mixing bath 93Y. Therefore, the liquid developer is naturally supplied from the liquid developer mixing bath 93Y to the supply section 31*a*Y through the communicating section 35Y.

The communicating section 35Y is provided below the liquid developer stirring roller 34Y in the liquid developer storage section 31Y. Further, the communicating section 35Y is in communication with the liquid developer mixing bath 93Y through feeding means. The communicating section 35Y is a part through which the liquid developer is supplied from the liquid developer mixing bath 93Y to the supply section 31*a*Y.

Since the communicating section 35Y is provided below the liquid developer stirring roller 34Y in the liquid developer storage section 31Y, it is difficult for the liquid developer to enter into the supply section 31*a*Y through the communicating section 35Y. Therefore, no ruffle is observed on the surface of the liquid developer by the reverse flow of the liquid developer thorough the communicating section 35Y.

As a result, it is possible to maintain the stable surface of the liquid developer in the supply section 31*a*Y, thereby enabling the liquid developer to be supplied to the application roller 32Y reliably.

The collecting screw 36Y which is provided in the vicinity of the bottom of the collecting section 31*b*Y is made of a cylindrical member and has a helically rib on a outer circumferential thereof. Further, the collecting screw 36Y has a function of keeping fluidity of the liquid developer collected from the developer collecting sections 15Y and 24Y. Furthermore, the collecting screw 36Y also has a function of facilitating supply of the liquid developer to the liquid developer mixing bath 93Y.

The developing roller 20Y is provided for conveying the liquid developer to a developing position opposed to the photoreceptor 10Y in order to develop a latent image carried on the photoreceptor 10Y with the liquid developer.

The liquid developer from the application roller 32Y is supplied onto the surface of the developing roller 20Y so that a layer of the liquid developer 201Y is formed on the surface.

The developing roller 20Y includes an inner core member made of a metal such as iron or the like and an elastic layer having conductivity and provided onto an outer periphery of the inner core member. The diameter of the developing roller 20Y is about 20 mm.

The elastic layer has a two layered structure which includes an inner layer made of urethane rubber and an outer layer (surface layer) made of urethane rubber. The inner layer has a rubber hardness of 30 according to JIS-A and a thickness of about 5 mm, and the outer layer has a rubber hardness of about 85 according to JIS-A and a thickness of about 30 μm.

The developing roller 20Y is in press contact with both the application roller 32Y and the photoreceptor 10Y in a state that the outer layer of the developing roller 20Y is elastically deformed.

The developing roller 20Y is rotatable about its central axis, and the central axis is positioned below the central axis of the photoreceptor 10Y. Further, the developing roller 20Y rotates in a direction (clockwise direction in FIG. 2) opposite to the rotational direction (anti-clockwise direction in FIG. 2) of the photoreceptor 10Y.

It is to be noted that an electrical field is generated between the developing roller 20Y and the photoreceptor 10Y when a latent image formed on the photoreceptor 10Y is developed.

The corona electrification device (pressing means) 25Y is a device having a function of pressing the toner particles of the liquid developer carried by the developing roller 20Y. In other words, the corona electrification device 25Y is a device that applies an electrical field of the same polarity as the toner particles 1 to the liquid developer layer 201Y described above to thereby evenly distribute the toner particles at the vicinity of the developing roller 20Y in the liquid developer layer 201Y as shown in FIG. 3.

By evenly distributing the toner particles in this way, it is possible to improve an image density (developing efficiency), and as a result it becomes possible to obtain a high quality clear image.

In this regard, it is to be noted that the application roller 32Y is driven by a power source (not shown) which is difference from a power source for driving the developing roller 20Y. Therefore, by changing a rotational speed (linear velocity) ratio of each of the application roller 32Y and the developing roller 20Y, it is possible to adjust an amount of the liquid developer to be supplied onto the developing roller 20Y.

The developing unit 100Y has a developing roller cleaning blade 21Y made of rubber and provided in contact with the surface of the developing roller 20Y and a developer collecting section 24Y. The developing roller cleaning blade 21Y is a device for scrapping off the liquid developer remaining on the developing roller 20Y after the development of an image has been carried out at the developing position. The liquid developer removed by the developing roller cleaning blade 21Y is collected in the developer collecting section 24Y.

As shown in FIG. 1 and FIG. 2, the image forming apparatus 1000 is provided with liquid developer supply sections 90Y, 90M, 90C and 90K which supply the liquid developers to the developing sections 30Y, 30M, 30C and 30K, respectively.

The liquid developer supply sections 90Y, 90M, 90C and 90K have the same structure, respectively. Namely, the liquid developer supply sections 90Y, 90M, 90C and 90K are provided with liquid developer tanks 91Y, 91M, 91C and 91K, insulation liquid tanks 92Y, 92M, 92C and 92K and liquid developer mixing baths 93Y, 93M, 93C and 93K, respectively.

In each of the liquid developer tanks 91Y, 91M, 91C and 81Y, a liquid developer of high concentration which corresponds to each of the different colors is stored. Further, in each of the insulation liquid tanks 92Y, 92M, 92C and 92K, the insulation liquid is stored.

Further, each of the liquid developer mixing baths 93Y, 93M, 93C and 93K is constructed so that a predetermined amount of the high concentration liquid developer is supplied from each of the corresponding liquid developer tanks 91Y, 91M, 91C and 91Y and a predetermined amount of the insulation liquid is supplied from each of the corresponding insulation liquid tanks 92Y, 92M, 92C and 92K.

In each of the liquid developer mixing baths 93Y, 93M, 93C and 93K, the supplied high concentration liquid developer and the supplied insulation liquid are mixed with being stirred to prepare the liquid developers corresponding to different colors which are to be used in the supply sections 31*a*Y, 31*a*M, 31*a*C and 31*a*K, respectively. The liquid developers prepared in the respective liquid developer mixing baths 93Y, 93M, 93C and 93K in this way are supplied to the corresponding supply sections 31*a*Y, 31*a*M, 31*a*C and 31*a*K, respectively.

Further, the liquid developers collected in the respective collecting sections 31*b*Y, 31*b*M, 31*b*C and 31*b*K are respectively collected to the liquid developer mixing baths 93Y, 93M, 93C and 93K and then they are reused.

In this regard, the method of forming the image using the image forming apparatus includes a developing step, a transferring step, and a fixing step.

The developing step is a step in which monochromatic images corresponding to respective colors are formed on photoreceptors 10 (10Y, 10M, 10C, 10K) by using the liquid developers of the different colors as described above, respectively.

The transferring step is a step in which the monochromatic images corresponding to the respective colors, which are formed on the photoreceptors 10Y, 10M, 10C, 10K, are transferred on the intermediate transfer section 40, respectively, and then an unfixed toner image F5*a* obtained by overlaying each of the monochromatic images on the intermediate transfer section 40 is formed on the recording medium F5.

The fixing step is a step in which the unfixed toner image F5*a* is fixed on the recording medium F5 by irradiating an ultraviolet ray thereto to obtain a fixed toner image.

Use of such a method makes it possible to quickly fix the toner image F5*a* to the recording medium F5, thereby enabling the image to form at a high speed.

Second Embodiment

Next, a description will be made with regard to a second embodiment of the method of forming the image of the present invention. The method of forming the image of this embodiment is different from the method of the first embodiment in a fixing step. That is, the fixing step of the method of the second embodiment is a step in which an unfixed toner image is subjected to a heating treatment, and then the unfixed toner image is fixed onto a recording medium by irradiating an ultraviolet ray thereto.

Hereinafter, a description will be made on the method of forming the image according to this embodiment with reference to an image forming apparatus.

Figure 4:
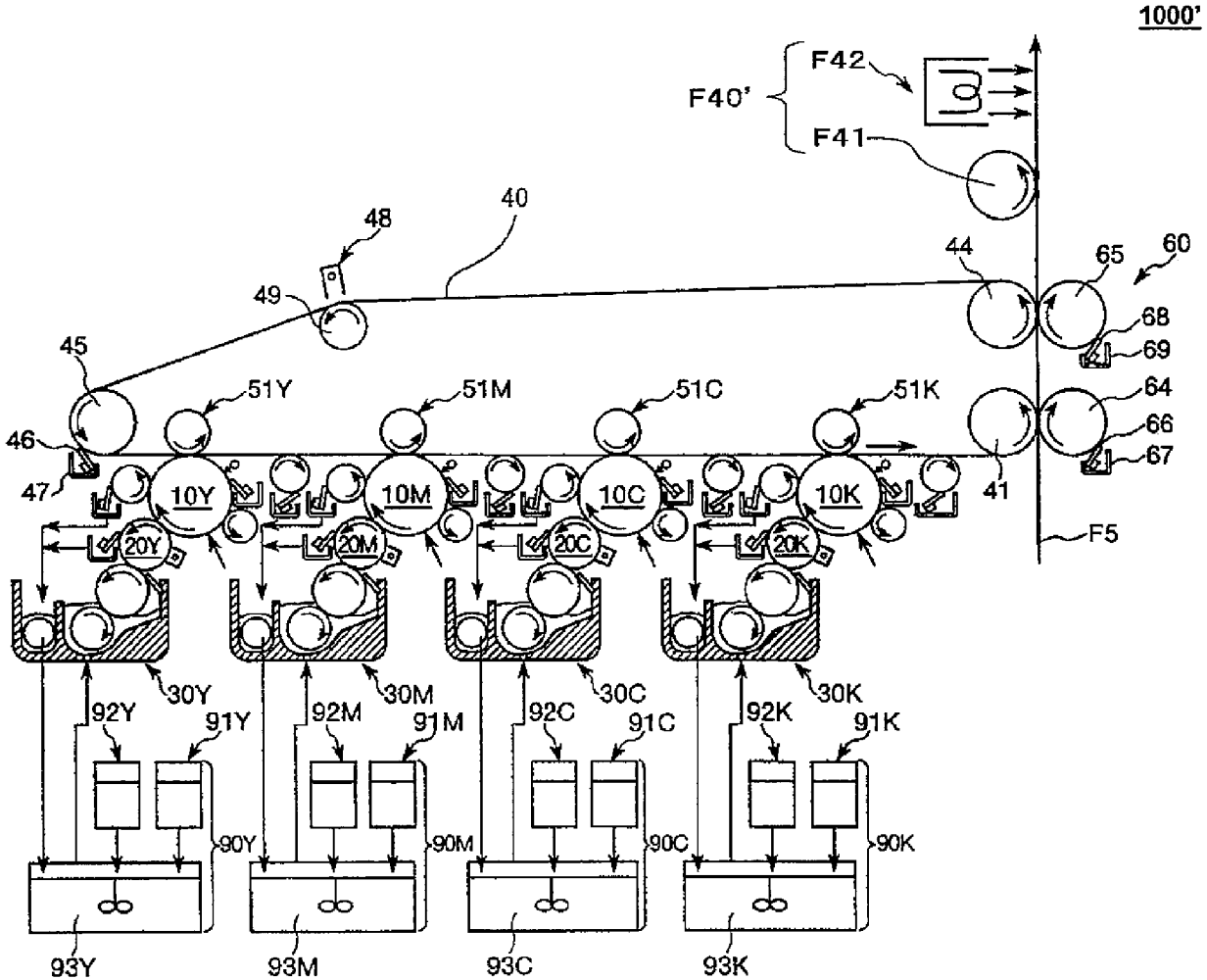
FIG. 4 is a schematic view which shows a preferred embodiment of an image forming apparatus that can be used to a second embodiment of the method of forming the image of the present invention.

FIG. 4 is a schematic view which shows a preferred embodiment of an image forming apparatus that can be used to the second embodiment of the method of forming the image of the present invention.

As shown in FIG. 4, the image forming apparatus 1000' has the same configuration as that of the first embodiment except that a fixing unit F40' includes a heating roller (heating means) F41 and an ultraviolet emitting means F42.

The heating roller (heating means) F41 included in the fixing unit F40' of this embodiment is provided between the secondary transfer unit 60 and the ultraviolet emitting means F42. The heating roller 41 rotates in an anti-clockwise direction which is shown by the arrow in FIG. 4. The heating roller 41 heats the unfixed toner image F5*a* transferred onto the recording medium F5 by being in contact with it, while feeding the recording medium F5 to the ultraviolet emitting means F42.

Since the ultraviolet emitting means F42 has the same configuration as that of the first embodiment, the description of the ultraviolet emitting means F42 is omitted in this embodiment.

In the method of forming the image using the image forming apparatus 1000', after the unfixed toner image F5*a* transferred onto the recording medium F5 in the secondary transfer unit 60 is heated by the heating roller 41, the ultraviolet ray is irradiated to the unfixed toner image F5*a* by the ultraviolet emitting means F42. As a result, the unfixed toner image F5*a* is fixed to the recording medium F5.

In such a method of forming the image, since the unfixed toner image F5*a* is heated by the heating roller 41, the toner particles constituting the unfixed toner image F5*a* are fused.

When the ultraviolet ray is irradiated to the unfixed toner image F5*a* by the ultraviolet emitting means F42 so that the insulation liquid existing in the unfixed toner image F5*a* is solidified, it is possible to firmly fix the fused toner particles onto the recording medium F5.

When the toner particles are fixed onto the recording medium F5, adjacent toner particles adhere to each other due to the fused toner particles. Therefore, since no gaps between the adjacent toner particles are obtained in the unfixed toner image F5*a*, the thus fixed toner image F5*a* exhibits superior color development in respective colors thereof.

Further, the fused toner particles are embedded into gaps existing on the surface of the recording medium F5 such as a paper or the like, thereby improving adhesion between the recording medium F5 and the toner particles. Therefore, it is possible to reliably improve fixing strength of the toner image F5*a*.

A temperature of heating the recording medium F5 on which the toner image F5*a* is transferred in the heating roller 41 is preferably in the range of 70 to 160° C., more preferably in the range of 100 to 150° C., and even more preferably in the range of 100 to 140° C.

In the above description, the heating roller 41 having a roller shape has been described as the heating means. However, the heating means is not limited to the heating roller 41, but may be a means in which heated air is blown to the toner image F5*a*.

In the foregoing, the invention was described based on the preferred embodiments, but the invention is not limited to these embodiments.

For example, the liquid developer of the present invention is not limited to one that is to be used in the image forming apparatuses and the methods of forming the image as described above. Further, the method of forming the image of the present invention is not limited to one that is to be used in the image forming apparatuses as described above.

Further, the liquid developer of the present invention is not limited to one produced by the method as described above.

Further, in the above described embodiments, an electrolyte is added to the water-based dispersion liquid obtained by adding the resin solution to the water-based liquid so that the particles of the dispersoid are associated to thereby form associated particles. But the present invention is not limited thereto.

For example, a coloring agent, a monomer of a resin material described above, a dispersant described above, a interfacial active agent and a polymerization initiator are dispersed in the water-based liquid, and a water-based emulsion is prepared by an emulsion polymerization, and then an electrolyte is added to the water-based emulsion, so that the particles of the dispersoid are associated to thereby form associated particles (this method is called as "emulsion polymerization association method")

Further, the obtained water-based emulsion may be dried by a spry to thereby obtain associated particles. Further, it is to be noted that the image forming apparatus includes the corona electrification device in the embodiments described above, but the image forming apparatus may not include the corona electrification device.

EXAMPLES

1. Production of Liquid Developer

Liquid developers were produced as follows.

Example 1

First, toner particles were produced. In this regard, it is to be noted that in this specification steps of the liquid developer in which a temperature is not mentioned were carried out at room temperature (25° C.).

Step of Preparing Dispersion Liquid

Preparation of Coloring Agent Master Batch

First, 60 parts by weight of a polyester resin (acid value thereof was 10 mgKOH/g, glass transition point (Tg) thereof was 55° C., and softening point thereof was 107° C.) as a resin material and 60 parts by weight of cyan type pigment ("Pigment Blue 15:3" produced by Dainichiseika Color & Chemicals Mfg. Co., Ltd.) as a coloring agent were prepared. These components were mixed at a mass ratio of 50:50 using a 20 L type Henschel mixer to obtain a material for producing toner particles.

Next, the material (mixture) was kneaded using a biaxial kneader-extruder. The kneaded material extruded from an extruding port of the biaxial kneader-extruder was cooled. The kneaded material that had been cooled as described above was coarsely ground using a hammer mill to be formed into powder constituting a coloring agent master batch which had an average particle size of 1.0 mm or less. In this way, the coloring agent master batch was obtained.

Preparation of Resin Solution

Next, 175 parts by weight of methylethylketone, and 227.6 parts by weight of the polyester resin described above were added into a flask in which 97.5 parts by weight of the coloring agent master batch was contained to obtain a mixture, and then the mixture was stirred with a high speed disperser ("T.K. ROBOMIX/T.K. HOMO DISPER MODEL 2.5" produced by PRIMIX Corporation, which are the registered trademarks)

And then, 1.38 parts by weight of NEOGEN SC-F (an emulsifying agent produced by DAI-ICHI KOGYO SEIYAKU Co., LTD.) was added into the mixture to obtain a resin solution. In the resin solution, the pigment was finely dispersed homogeneously.

Formation of Dispersoid

Next, 72.8 parts by weight of 1N ammonia water was added to the resin solution in the flask to obtain a mixture. Then, the mixture was sufficiently stirred by a high speed disperser ("T.K. ROBOMIX/T.K. HOMO DISPER MODEL 2.5" produced by PRIMIX Corporation, which are the registered trademarks) under the conditions that a rotational velocity of a tip of a stirring blade thereof was 7.5 m/s.

Thereafter, 400 parts by weight of deionized water was added into the mixture in the flask drop by drop under the conditions that the temperature of the mixture in the flask was adjusted at 25° C. and the mixture was stirred at 14.7 m/s of the rotational velocity of the tip of the stirring blade to thereby cause phase inversion emulsification. Thereafter, 100 parts by weight of deionized water was added into the mixture in the flask while stirring the mixture.

In this way, a water-based dispersion liquid in which a dispersoid composed of the resin material was dispersed was obtained.

Associated Particle Formation Step

Next, the water-based dispersion liquid was put into a stirring flask having a maxblend stirring blade. Then, the water-based dispersion liquid was continued to be stirred under the conditions that the temperature of the water-based dispersion liquid in the stirring flask was adjusted at 25° C. and the water-based dispersion liquid was stirred at 1.0 m/s of the rotational velocity of the tip of the stirring blade.

Thereafter, 200 parts by weight of 5.0% sodium sulfate solution was added into the water-based dispersion liquid drop by drop under the same conditions as described above to produce associated particles by associating fine particles of the dispersoid in the water-based dispersion liquid.

After the addition of the sodium sulfate solution to the water-based dispersion liquid was ended, the water-based until the average particle size (the volume median diameter Dv (50)) of the associated particles became 3.5 μm to obtain an associated particle dispersion liquid. Thereafter, 200 parts by weight of deionized water was added into the associated particle dispersion liquid.

In this way, the production process of the associated particles was completed.

Solvent Removing Step

The obtained associated particle dispersion liquid was dried under reduced pressure to remove the organic solvent (methylethylketone) so that an amount of a solid content contained in the associated particle dispersion liquid became 23 wt % and to thereby obtain a slurry containing the associated particles (resin fine particles) of the dispersoid.

Washing Step

Next, by repeatedly carrying out the process that the slurry was separated into a solid content and a liquid content and then the solid content separated from the slurry was dispersed into deionized water to thereby obtain a slurry, the associated particles were washed. Thereafter, by using a suction filtration method, a wet cake containing the resin fine material (polyester resin) and the coloring agent was obtained. In this regard, an amount of moisture content in the wet cake was 35 wt %.

Drying Step

Next, the wet cake was dried by using a vacuum drier to thereby obtain toner particles.

Dispersion Step 37.5 parts by weight of the thus obtained toner particles, 4.5 parts by weight of diphenyl iodonium hexafluorophosphate as a cation type photopolymerization initiator, 150 parts by weight of an epoxidized linseed oil as an modified epoxy compound were put in a ceramics pot (the size of the ceramic pot was 600 ml), and then zirconia balls each having a diameter of 1 mm were added in the ceramics pot so that a volume filling factor thereof became 85%.

They were then mixed by a desk pot mill at a rotational speed of 230 rpm for 24 hours, to thereby obtain a liquid developer in which the toner particles were dispersed in the insulation liquid.

In this regard, it is to be noted that a compound obtained by oxidizing an unsaturated fatty acid component constituting a constituent material of the linseed oil with peracetic was used as the epoxidized linseed oil described above.

The average particle size (the volume median diameter Dv (50)) of the thus obtained toner particles was 3.2 μm. In this regard, it is to be noted that volume median diameters Dv (50) of the associated particles obtained in each of the Examples 1 to 7 and the Comparative Examples 1 and 2 were measured in the volume basis with a particle analysis apparatus ("Mastersizer 2000" produced by Malvern Instruments Ltd.).

Further, a viscosity of the obtained liquid developer at a temperature of 25° C. was 65 mPa·s.

Furthermore, a magenta liquid developer, a yellow liquid developer, and a black liquid developer which were the same as those described above were produced excepting that Pigment Red 238 (produced by Sanyo Color Works) as a magenta pigment, Pigment Yellow 180 (Clariant K.K.) as a yellow pigment, and a carbon black ("Printex L", produced by Degussa AG) as a black pigment were respectively used instead of the cyanine pigment.

Examples 2 to 4

Liquid developers of respective colors were produced in the same manner as in the Example 1 except that the cation type photopolymerization initiator, the amount of the cation type photopolymerization initiator, and the modified epoxy compound were changed to those as shown in Table 1, respectively.

Example 5

Liquid developers of respective colors were produced in the same manner as in the Example 1 except that the polyester resin was changed to an epoxy resin (a glass transition temperature (Tg) thereof was 60° C. and a softening temperature thereof was 120° C.), and the cation type photopolymerization initiator, the amount of the cation type photopolymerization initiator, and the modified epoxy compound were changed to those as shown in Table 1, respectively.

Examples 6 and 7

Liquid developers of respective colors were produced in the same manner as in the Example 1 except that the modified epoxy compound was changed to that as shown in Table 1.

Comparative Example 1

Liquid developers of respective colors were produced in the same manner as in the Example 1 except that the epoxidized linseed oil was changed to liquid paraffin (produced by COSMO OIL Co., Ltd., "COSMOWHITE P-70") as the insulation liquid, and the cation type photopolymerization initiator was not used.

Comparative Example 2

Liquid developers of respective colors were produced in the same manner as in the Example 1 except that the epoxidized linseed oil was changed to a mixture of high-oleic (HO) rape oil ("high-oleic rape oil" produced by The Nisshin OilliO Group, Ltd.) of 90 parts by weight and soy oil fatty acid methyl of 60 parts by weight which was obtained by ester-exchange reacting a soy oil and methanol as an insulation liquid.

In each of the Examples 1 to 7 and each of the Comparative Examples 1 and 2, compositions of the liquid developers of respective colors were shown in Table 1. That is, the toner particles, the cation type photopolymerization initiator, the amount thereof, the modified epoxy compound, the amount thereof, other components, and the like were shown in Table 1. In this regard, it is to be noted that in Table 1 the used pigments were omitted.

In this regard, in Table 1, it is also to be noted that the polyester resin is shown as "PES", the epoxy resin is shown as "EP", diphenyl iodonium hexafluorophosphate is shown as "a", triphenyl sulfonium hexafluorophosphate is shown as "b", the epoxidizid linseed oil is shown as "A", an epoxidizid soy oil obtain by oxidizing an unsaturated fatty acid component constituting a constituent material of a soy oil with peracetic is shown as "B", a modified epoxy silicone oil (produced by Shin-Etsu Chemical Co., Ltd., "X-22-9002") is shown as "C".

Further, it is also to be noted that an epoxidizid rape oil obtained by oxidizing an unsaturated fatty acid component constituting a constituent material of a rape oil with peracetic is shown as "D", an epoxidizid rape oil having a different iodine value as that of D, which is obtained by the same method as that of D, is shown as "E", the liquid paraffin (produced by COSMO OIL Co., Ltd., "COSMOWHITE P-70") is shown as "F", the HO rape oil is shown as "G", and the soy oil fatty acid methyl is shown as "H".

The modified epoxy silicone oil was obtained by substituting a part of branch chains and methyl groups of both ends of a main chain of polysiloxane to alkyl groups containing epoxy groups.

TABLE 1

| | Liquid developer | | | | | | | | | |
|---|---|---|---|---|---|---|---|---|---|---|
| | | Cation type photopolymerization initiator | | Insulation liquid | | | | | | |
| | | | | Modified epoxy compound | | | | | | |
| | | | | | Raw material | | | Amount of modified epoxy compound | | |
| | Toner particles Resin material | Kind | Amount of cation type photpolymerization initiator to 100 parts by weight of modified epoxy compound (parts by weight) | Kind | Kind | Iodine value $I_1$ | Iodine value $I_2$ | containend in insulation liquid [wt %] | $I_2/I_1$ | Other components Kind |
| Ex. 1 | PEs | a | 3 | A | Linseed oil | 190 | 6 | 100 | 0.032 | — |
| Ex. 2 | PEs | b | 5 | B | Soy oil | 120 | 2 | 100 | 0.016 | — |
| Ex. 3 | PEs | a | 3 | C | Polysiloxane | — | — | 50 | — | — |
| | | | | A | Linseed oil | 190 | 6 | 50 | 0.032 | |
| Ex. 4 | PEs | a | 0.8 | A | Linseed oil | 190 | 6 | 100 | 0.032 | — |
| Ex. 5 | EP | b | 7 | A | Linseed oil | 190 | 6 | 100 | 0.032 | — |
| Ex. 6 | PEs | a | 3 | D | Rape oil | 100 | 15 | 100 | 0.15 | — |
| Ex. 7 | PEs | a | 3 | E | Rape oil | 100 | 18 | 100 | 0.18 | — |
| Comp. Ex. 1 | PEs | — | — | — | — | — | — | — | — | F |
| Comp. Ex. 2 | PEs | — | — | — | — | — | — | — | — | G, H |

2 Evaluation

For the respective liquid developers produced as described above, the following evaluations were made.

2.1 Fixing Strength (Fixing Characteristics) and Image Forming Property at High Speed By using the image forming apparatus as shown in FIG. 1 and FIG. 2, toner images each having a predetermined pattern were formed on recording papers (High quality paper LPCPPA4 produced by Seiko Epson Corporation) employing the liquid developers of different colors of the Examples 1 to 7, respectively.

Then, the toner images formed on the papers were fixed onto the papers by irradiating an ultraviolet ray thereto, respectively. In this regard, it is to be noted that a feeding speed of the papers was set 320 mm/sec and irradiation energy of the ultraviolet ray to be irradiated to the images was set 70 mJ/cm$^2$.

Further, in the fixing unit of the image forming apparatus shown in FIG. 1 and FIG. 2, the ultraviolet emitting means was changed to a thermo fixing means having a pressing roller and a thermo fixing roller to prepare an image forming apparatus.

By using such an image forming apparatus, toner images each having a predetermined pattern were formed on the recording papers employing the liquid developers of different colors of the Comparative Examples 1 and 2, respectively. Then, the images formed on the papers were thermally fixed onto the papers.

In this regard, it is to be noted that a feeding speed of the papers was set 320 mm/sec, a pressure applied by the pressing roller was set 4 kgf, and a temperature of the thermo fixing roller was set 125° C.

Thereafter, after it was confirmed as to whether or not a non-offset area was present, the fixed image on each of the papers was rubbed out twice using a sand eraser ("LION 261-11", Product of LION OFFICE PRODUCTS CORP.) with a pressure loading of 1.5 kgf.

Then, the residual rate of the image density of each recording paper was measured by a calorimeter "X-Rite model 404" (X-Rite Incorporated), and the measurement results were evaluated according to the following five criteria A to E.

Furthermore, the feeding speed of the papers was changed to 100 mm/sec and 450 mm/sec, and then evaluations was made in the same manner as the evaluation as described above.

A: Residual rate of the image density was 95% or higher (very good).

B: Residual rate of the image density was 90% or higher but lower than 95% (good)

C: Residual rate of the image density was 80% or higher but lower than 90% (acceptable range).

D: Residual rate of the image density was 70% or higher but lower than 80% (bad).

E: Residual rate of the image density was lower than 70% (very bad).

2.2 Blocking Resistance of Fixed Images

In the liquid developers obtained in each of the Examples 1 to 7 and each of the Comparative Examples 1 and 2, a blocking resistance was evaluated as follows.

First, the image forming apparatus as shown in FIG. 1 and FIG. 2 was prepared. By using the image forming apparatus, toner images of respective colors each having a predetermined pattern were transferred on recording papers (High quality paper LPCPPA4 produced by Seiko Epson Corporation) so that a weight of the toner particles included in each of the toner images formed on the recording papers was 0.75 mg/cm$^2$.

Then, the toner images transferred on the papers were fixed onto the papers in the same manner as in the item [2.1] to obtain fixed toner images. In this regard, it is to be noted that a feeding speed of the papers was set 320 mm/sec.

Two recording papers on which the toner images were fixed were overlapped to each other so as to allow the toner images thereof to adhere to each other. Then, a weight was put on the overlapped two recording papers at a temperature of 55° C., and then it was left for 24 hours with a pressure loading of 1.2 kg/cm$^2$ to thereby allow the toner images on the two recording papers to adhere to each other.

Thereafter, the weight was removed from the overlapped two recording papers, and then the overlapped two recording papers was cooled to room temperature (25° C.). After cooling, the two recording papers were peeled to each other so that the toner images, which were allowed to adhere, were also peeled to each other. Then, the peeled toner images were observed in a visible manner.

The observation results, namely, determinations as to whether or not toner particles which have been included in one toner image adhered to the other tone image, uneven color, and uneven density were evaluated according to the following four criteria A to D.

A: Adhering toner particles, uneven color, and uneven density were not observed on each of the toner images at all.

B: Adhering toner particles, uneven color, and uneven density were scarcely observed on each of the toner images.

C: Adhering toner particles, uneven color, and uneven density were slightly observed on each of the toner images.

D: Adhering toner particles, uneven color, and uneven density were clearly observed on each of the toner images.

2.3 Storage Stability

The liquid developers of the different colors obtained in each of the Examples 1 to 7 and the Comparative Examples 1 and 2 were being placed (left) under the atmosphere at a temperature of 50° C. and a relative humidity of 60% for eight months.

Thereafter, conditions of each of the liquid developers of the different colors after the eight month period were subjected to a viscometer and an electrometer to obtain the following changes and visually observed. Then, the measurement and observation results including changes in its viscosity, color, acid numbers, and electric resistance were evaluated by the following five criteria A to E.

In this regard, it is to be noted that the acid number of each liquid developer was measured according to JIS K2501. Further, change of color of each liquid developer was visually observed. A viscosity of each liquid developer was measured according to JIS Z8809 using a vibration type viscometer.

Electric resistance of each liquid developer was measured by using Universal Electrometer MMAII-17B, electrodes for liquid LP-05, and Sealed Box P-618 (produced by Kawaguchi Electric Works Co., Ltd.).

A: Viscosity change, color change, acid numbers change and electric resistance change of the liquid developers of different colors were not observed at all.

B: Viscosity change, color change, acid numbers change and electric resistance change of the liquid developers of different colors were scarcely observed.

C: Viscosity change, color change, acid numbers change and electric resistance change of the liquid developers of different colors were slightly observed, but they were within the range where the liquid developers could be practically used.

D: Viscosity change, color change, acid numbers change and electric resistance change of the liquid developers of different colors were clearly observed.

E: Viscosity change, color change, acid numbers change and electric resistance change of the liquid developers of different colors were conspicuously observed.

2.4 Preservability

The liquid developers obtained in the Examples 1 to 7 and the Comparative Examples 1 and 2 were being placed under the atmosphere at a temperature in the range of 20 to 30° C. for four months, respectively. Thereafter, conditions of the toner particles in the liquid developers were visually observed, and the observation results were evaluated by the following five criteria A to E.

A: Suspension of toner particles and aggregation and settling of toner particles were not observed at all.

B: Suspension of toner particles and aggregation and settling of toner particles were scarcely observed.

C: Suspension of toner particles and aggregation and settling of toner particles were slightly observed, but they were within the range where the liquid developers could be practically used.

D: Suspension of toner particles and aggregation and settling of toner particles were clearly observed.

E: Suspension of toner particles and aggregation and settling of toner particles were conspicuously observed.

2.5 Gloss Level of Toner Images

By using the image forming apparatus shown in FIG. 1 and FIG. 2, toner images each having a predetermined pattern were formed on recording papers (High quality paper LPCPPA4 produced by Seiko Epson Corporation) employing the liquid developers of the different colors of the Examples 1 to 7, respectively. Then, the toner images formed on the papers were fixed onto the papers by irradiating an ultraviolet ray thereto.

In this regard, it is to be noted that a feeding speed of the papers was set 320 mm/sec and irradiation energy of the ultraviolet ray to be irradiated to the toner images was set 70 mJ/cm$^2$.

Further, toner images each having a predetermined pattern were formed on recording papers (High quality paper LPCPPA4 produced by Seiko Epson Corporation) employing the liquid developers of the different colors of the Comparative Examples 1 and 2 in the same manner as the item [2.1] respectively.

A gloss level of each of the toner images formed on the recording papers using the liquid developers of different colors obtained in the Examples 1 to 7 and the Comparative Examples 1 and 2 was measured using a gloss meter ("GM-26D" produced by MURAKAMI COLOR RESEARCH LABORATORY), and the measurement results were evaluated according to the following four criteria A to D.

A: Gloss level of the toner image on the recording paper was 8 or higher.

B: Gloss level of the toner image on the recording paper was 7 or higher but lower than 8.

C: Gloss level of the toner image on the recording paper was 6 or higher but lower than 7.

D: Gloss level of the toner image on the recording paper was lower than 6.

These results are shown in Table 2.

TABLE 2

| | Fixing characteristics | | | | | | |
|---|---|---|---|---|---|---|---|
| | Fixing strength and image forming property at high speed Feeding speed | | | | Preservability or storage stability | | Color development |
| | 100 [mm/sec] | 320 [mm/sec] | 450 [mm/sec] | Blocking resistance | Storage stability | Preservability | (gloss level) |
| Ex. 1 | A | A | A | A | A | A | B |
| Ex. 2 | A | A | A | A | A | A | B |
| Ex. 3 | A | B | C | A | B | B | B |
| Ex. 4 | A | B | B | B | A | A | B |
| Ex. 5 | A | A | A | A | B | B | C |
| Ex. 6 | A | B | B | B | A | A | B |
| Ex. 7 | A | B | B | B | A | A | B |
| Comp. Ex. 1 | C | E | E | D | A | A | C |
| Comp. Ex. 2 | C | E | E | D | A | A | D |

3 Evaluation

For the respective liquid developers produced as described above, the following evaluations were made.

3.1 Fixing Strength (Fixing Characteristics) and Image Forming Property at High Speed By using the image forming apparatus as shown in FIG. 4, toner images each having a predetermined pattern were formed on recording papers (High quality paper LPCPPA4 produced by Seiko Epson Corporation) employing the liquid developers of different colors of the Examples 1 to 7, respectively. Then, the toner images formed on the papers were fixed onto the papers by irradiating an ultraviolet ray thereto.

In this regard, it is to be noted that a feeding speed of the papers was set 320 mm/sec, irradiation energy of the ultraviolet ray to be irradiated to the toner images was set 70 mJ/cm$^2$, and a temperature of the heating roller F41 was set 125° C.

Thereafter, after it was confirmed as to whether or not a non-offset area was present, the fixed image on each of the papers was rubbed out twice using a sand eraser ("LION 261-11", Product of LION OFFICE PRODUCTS CORP.) with a pressure loading of 2.0 kgf. Then, the residual rate of the image density of each recording paper was measured by a calorimeter "X-Rite model 404" (X-Rite Incorporated), and the measurement results were evaluated according to the following five criteria A to E.

Furthermore, the feeding speed of the papers was changed to 100 mm/sec and 450 mm/sec, and then evaluations was made in the same manner as the evaluation as described above.

A: Residual rate of the image density was 95% or higher (very good).

B: Residual rate of the image density was 90% or higher but lower than 95% (good).

C: Residual rate of the image density was 80% or higher but lower than 90% (acceptable range).

D: Residual rate of the image density was 70% or higher but lower than 80% (bad).

E: Residual rate of the image density was lower than 70% (very bad).

3.2 Blocking Resistance of Fixed Images

In the liquid developers obtained in each of the Examples 1 to 7, a blocking resistance was evaluated as follows.

First, the image forming apparatus as shown in FIG. 4 was prepared. By using the image forming apparatus, toner images of respective colors each having a predetermined pattern were formed on recording papers (High quality paper LPCPPA4 produced by Seiko Epson Corporation) so that a weight of the toner particles included in the toner images formed on the recording papers was 0.75 mg/cm$^2$.

Then, the toner images formed on the papers were fixed onto the papers in the same manner as in the item [2.1] to obtain fixed toner images. In this regard, it is to be noted that a feeding speed of the papers was set 320 mm/sec.

Two recording papers on which the toner images were formed were overlapped to each other so as to allow the toner images thereof to adhere to each other. Then, a weight was put on the overlapped two recording papers at a temperature of 55° C., and then it was left for 24 hours with a pressure loading of 1.5 kg/cm$^2$ to thereby allow the toner images on the two recording papers to adhere to each other.

Thereafter, the weight was removed from the overlapped two recording papers, and then the overlapped two recording papers was cooled to room temperature (25° C.). After cooling, the two recording papers were peeled to each other so that the toner images, which were allowed to adhere, were also peeled to each other. Then, the peeled toner images were observed in a visible manner.

The observation results, namely, determinations as to whether or not toner particles which have been included in one toner image adhered to the other tone image, uneven color, and uneven density were evaluated according to the following four criteria A to D.

A: Adhering toner particles, uneven color, and uneven density were not observed on each of the toner images at all.

B: Adhering toner particles, uneven color, and uneven density were scarcely observed on each of the toner images.

C: Adhering toner particles, uneven color, and uneven density were slightly observed on each of the toner images.

D: Adhering toner particles, uneven color, and uneven density were clearly observed on each of the toner images.

3.3 Gloss Level of Toner Images

By using the image forming apparatus shown in FIG. 4, toner images each having a predetermined pattern were formed on recording papers (High quality paper LPCPPA4 produced by Seiko Epson Corporation) employing the liquid developers of the different colors of the Examples 1 to 7, respectively. Then, the toner images formed on the papers were fixed onto the papers by irradiating an ultraviolet ray thereto.

In this regard, it is to be noted that a feeding speed of the papers was set 320 mm/sec, irradiation energy of the ultraviolet ray to be irradiated to the toner images was set 70 mJ/cm$^2$ and a temperature of the heating roller F41 was set 125° C.

A gloss level of each of the toner images formed on the recording papers using the liquid developers of the different colors obtained in the Examples 1 to 7 was measured using a gloss meter ("GM-26D" produced by MURAKAMI COLOR RESEARCH LABORATORY), and the measurement results were evaluated according to the following four criteria A to D.

A: Gloss level of the toner image on the recording paper was 8 or higher.

B: Gloss level of the toner image on the recording paper was 7 or higher but lower than 8.

C: Gloss level of the toner image on the recording paper was 6 or higher but lower than 7.

D: Gloss level of the toner image on the recording paper was lower than 6.

These results are shown in Table 3.

TABLE 3

| | Fixing characteristics | | | | |
|---|---|---|---|---|---|
| | Fixing strength and image forming property at high speed Feeding speed | | | | Color |
| | 100 [mm/sec] | 320 [mm/sec] | 450 [mm/sec] | Blocking resistance | development (gloss level) |
| Ex. 1 | A | A | A | A | A |
| Ex. 2 | A | A | A | A | A |
| Ex. 3 | A | A | B | A | A |
| Ex. 4 | A | A | A | A | A |
| Ex. 5 | A | A | A | A | B |
| Ex. 6 | A | A | A | A | A |
| Ex. 7 | A | A | A | A | A |

As shown in the Tables 2 and 3, the liquid developers according to the invention (that is, the liquid developers of the Examples 1 to 7) had excellent fixing strength, excellent image forming property at a high speed, and excellent blocking resistance. In contrast, in the liquid developers of the different colors of the Comparative Examples 1 and 2, satisfactory results could not be obtained.

The toner images were formed on the papers by using the liquid developers of the respective colors obtained in each of the Examples 1 to 7 and each of the image formation apparatuses shown in FIG. 1 and FIG. 4. As a result, color development of the toner images formed on the papers by using the image formation apparatus shown in FIG. 4 was superior to that of the toner images formed on the papers by using the image formation apparatus shown in FIG. 1.

What is claimed is:

1. A liquid developer, comprising:

an insulation liquid constituted of a modified epoxy compound as a main component thereof;

toner particles dispersed in the insulation liquid; and a cation type photopolymerization initiator used for polymerizing the modified epoxy compound, the cation type photopolymerization initiator contained in the insulation liquid.

2. The liquid developer as claimed in claim 1, wherein the modified epoxy compound is an epoxidized vegetable oil obtained by epoxidizing carbon double bonds of an unsaturated fatty acid component constituting a constituent material of a vegetable oil.

3. The liquid developer as claimed in claim 2, wherein an iodine value of the epoxidized vegetable oil is in the range of 15 or less.

4. The liquid developer as claimed in claim 3, wherein when the iodine value of the epoxidized vegetable oil is defined as "$I_1$" and an iodine value of the vegetable oil is defined as "$I_2$", the following relation is satisfied: $0 \leqq I_1/I_2 \leqq 0.17$.

5. The liquid developer as claimed in claim 2, wherein a number of the carbon double bonds of the unsaturated fatty acid component constituting the constituent material of the vegetable oil are two or more.

6. The liquid developer as claimed in claim 1, wherein the cation type photopolymerization initiator includes an aromatic sulfonium salt or an aromatic iodonium salt.

7. The liquid developer as claimed in claim 1, wherein an amount of the cation type photopolymerization initiator is in the range of 0.5 to 8 parts by weight with respect to 100 parts by weight of the modified epoxy compound.

8. A method of forming an image by using an image forming apparatus, the image forming apparatus including four developing sections each having a photoreceptor and an intermediate transfer section being into contact with the photoreceptor, and the four developing sections corresponding to respective colors, wherein the method comprising:

developing monochromatic images corresponding to the respective colors on the photoreceptors by using liquid developers of the respective colors, respectively;

transferring the monochromatic images corresponding to the respective colors on the intermediate transfer section, respectively;

forming an unfixed toner image onto an recording medium by overlaying the monochromatic images thereon; and fixing the unfixed toner image on the recording medium by irradiating an ultraviolet ray thereto to obtain a fixed toner image, wherein each of the liquid developers is comprised of an insulation liquid constituted of a modified epoxy compound as a main component thereof, toner particles dispersed in the insulation liquid, and a cation type photopolymerization initiator used for polymerizing the modified epoxy compound, the cation type photopolymerization initiator contained in the insulation liquid.

9. The method as claimed in claim 8, wherein in the fixing step an energy of the ultraviolet ray to be irradiated to the unfixed toner image is in the range of 25 to 500 $mJ/cm^2$, wherein the transferring, forming, and fixing steps are carried out while feeding the recording medium, wherein a feeding speed of the recording medium is in the range of 50 to 1000 mm/sec.

* * * * *

UNITED STATES PATENT AND TRADEMARK OFFICE

CERTIFICATE OF CORRECTION

PATENT NO. : 8,080,356 B2
APPLICATION NO. : 12/405001
DATED : December 20, 2011
INVENTOR(S) : Takashi Teshima It is certified that error appears in the above-identified patent and that said Letters Patent is hereby corrected as shown below:

On the Title page, Item (73), after Seiko Epson Corporation, please replace Toyko with --Tokyo--.

Signed and Sealed this
Tenth Day of July, 2012

David J. Kappos

David J. Kappos
*Director of the United States Patent and Trademark Office*